US010900757B2

(12) United States Patent
Blosser et al.

(10) Patent No.: US 10,900,757 B2
(45) Date of Patent: Jan. 26, 2021

(54) CUT-ON-CONTACT BROADHEAD

(71) Applicant: FeraDyne Outdoors, LLC, Superior, WI (US)

(72) Inventors: Benjamin D. Blosser, Corydon, KY (US); Jon Arthur Syverson, Cloquet, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

(21) Appl. No.: 16/567,321

(22) Filed: Sep. 11, 2019

(65) Prior Publication Data

US 2019/0390945 A1 Dec. 26, 2019

Related U.S. Application Data

(63) Continuation-in-part of application No. 16/161,713, filed on Oct. 16, 2018, now Pat. No. 10,458,763.

(60) Provisional application No. 62/574,168, filed on Oct. 18, 2017.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,676,512 A * 6/1987 Simo ..... F42B 6/08 473/584
5,046,744 A * 9/1991 Eddy ..... F42B 6/08 473/583
5,178,398 A * 1/1993 Eddy ..... F42B 6/08 473/583
5,458,341 A * 10/1995 Forrest ..... F42B 6/08 473/583
5,879,252 A * 3/1999 Johnson ..... F42B 6/08 473/583
6,322,464 B1 * 11/2001 Sestak ..... F42B 6/08 473/583
7,377,869 B2 * 5/2008 Wohlfeil ..... F42B 6/08 473/583
8,057,331 B2 * 11/2011 Hudkins ..... F42B 6/08 473/583
8,272,979 B1 * 9/2012 Cooper ..... F42B 6/08 473/583

(Continued)

*Primary Examiner* — John A Ricci
(74) *Attorney, Agent, or Firm* — Greenberg Traurig, LLP; Dipak J. Shah

(57) ABSTRACT

A cut-on-contact broadhead having a plurality of deployable blades rotatably coupled to a surface of a ferrule, and a plurality of channels disposed on the surface of the ferrule. At least a portion of each channel is defined at least in part by at least a portion of the ferrule and at least a portion of at least one of the plurality of blades. Each blade includes a tip, an impact shoulder, and a first and second cutting edges. During flight, the blades are in a fully retracted configuration forming a distal tip having sharp cutting edges defined at least in part by the first cutting edges of the blades. Upon impact, the distal tip initiates a bore in the target, the plurality of blades deploy into a swept-back configuration, and the second cutting edges expand and lengthen the bore initiated by the distal tip.

44 Claims, 26 Drawing Sheets

(56) References Cited

U.S. PATENT DOCUMENTS

| | | | | |
|---|---|---|---|---|
| 8,512,178 | B2 * | 8/2013 | Peetz | F42B 6/08 473/583 |
| 8,974,327 | B2 * | 3/2015 | Priore | F42B 6/08 473/583 |
| 8,986,141 | B2 * | 3/2015 | Pedersen | F42B 12/34 473/583 |
| 2003/0073525 | A1 * | 4/2003 | Liechty, II | F42B 6/08 473/583 |
| 2006/0084535 | A1 * | 4/2006 | Kuhn | F42B 6/08 473/583 |
| 2009/0124438 | A1 * | 5/2009 | Perkins, Jr. | F42B 6/08 473/584 |
| 2017/0176155 | A1 * | 6/2017 | Furia | F42B 6/08 |
| 2018/0128584 | A1 * | 5/2018 | Beck | F42B 6/08 |

* cited by examiner

CUT-ON-CONTACT BROADHEAD

CROSS-REFERENCE TO RELATED APPLICATIONS

This application is a continuation-in-part (CIP) of U.S. patent application Ser. No. 16/161,713 filed Oct. 16, 2018, which claims the benefit of U.S. Provisional Patent Application No. 62/574,168 filed Oct. 18, 2017, all of which are herein incorporated by reference in their entirety.

STATEMENT REGARDING FEDERALLY SPONSORED RESEARCH OR DEVELOPMENT

Not applicable.

TECHNICAL FIELD

The instant disclosure relates to archery. More particularly, the instant disclosure pertains to broadheads.

BACKGROUND

A wide range of arrowhead designs suitable for archery are commercially available. One category of arrowheads is the broadhead—a bladed arrowhead featuring multiple sharp cutting blades that are designed to greatly increase the effective cutting area of the arrowhead when it impacts a target. Broadheads are popular in the bowhunting industry, as the increased cutting radius of a broadhead results in larger entrance and exit wounds in a game animal struck by the broadhead, causing increased blood loss which kills the animal quickly and humanely, and provides a better blood trail for tracking and retrieval of the carcass.

While broadheads provide an improved cutting capability when compared to non-bladed field point or nib point arrowheads, some broadhead designs suffer from inferior aerodynamic properties in comparison with their non-bladed counterparts. The blades of the broadhead, if deployed during the flight of an arrow, can result in undesirable effects and cause the arrow to veer off course from the flight path.

Prior art broadhead designs have attempted to resolve the aerodynamic issues by retaining, at least in part, the deployable cutting blades of the broadhead within the ferrule body of the broadhead during flight. Upon impacting the target, the blades are deployed, moving outwardly from the ferrule body and exposing the sharp cutting edges of the blades once fully deployed. Such designs are known by those skilled in the art as an "expandable broadhead."

SUMMARY

A non-limiting exemplary embodiment of a broadhead includes a plurality of deployable blades rotatably coupled to a surface of a ferrule. Each blade of the plurality of blades includes a tip, an impact shoulder, a first cutting edge extending from the tip to proximate the impact shoulder, and a second cutting edge extending from the tip to proximate a location whereat the blade is rotatably coupled to the ferrule.

Another non-limiting exemplary embodiment of a broadhead includes a ferrule, a plurality of deployable blades rotatably coupled to a surface of the ferrule, and a plurality of channels disposed on at least a portion of the surface of the ferrule. At least a portion of each channel is defined at least in part by at least a portion of the ferrule and at least a portion of at least one of the plurality of blades.

Yet another non-limiting exemplary embodiment of a broadhead includes a ferrule, a plurality of deployable blades rotatably coupled to a surface of the ferrule, and a plurality of channels disposed on at least a portion of the surface of the ferrule. Each blade of the plurality of blades includes a tip, an impact shoulder, a first cutting edge extending from the tip to proximate the impact shoulder, and a second cutting edge extending from the tip to proximate a location whereat the blade is rotatably coupled to the ferrule. At least a portion of each channel is defined at least in part by at least a portion of the ferrule and at least a portion of at least one of the plurality of blades.

DETAILED DESCRIPTION

One or more non-limiting embodiments are described herein with reference to the accompanying drawings, wherein like numerals designate like elements. It should be clearly understood that there is no intent, implied or otherwise, to limit the disclosure in any way, shape or form to the embodiments illustrated and described herein. While multiple exemplary embodiments are provided, variations thereof will become apparent or obvious to a person of ordinary skills. Accordingly, any and all variants for providing functionalities similar to those described herein are considered as being within the metes and bounds of the instant disclosure.

Figure 1:
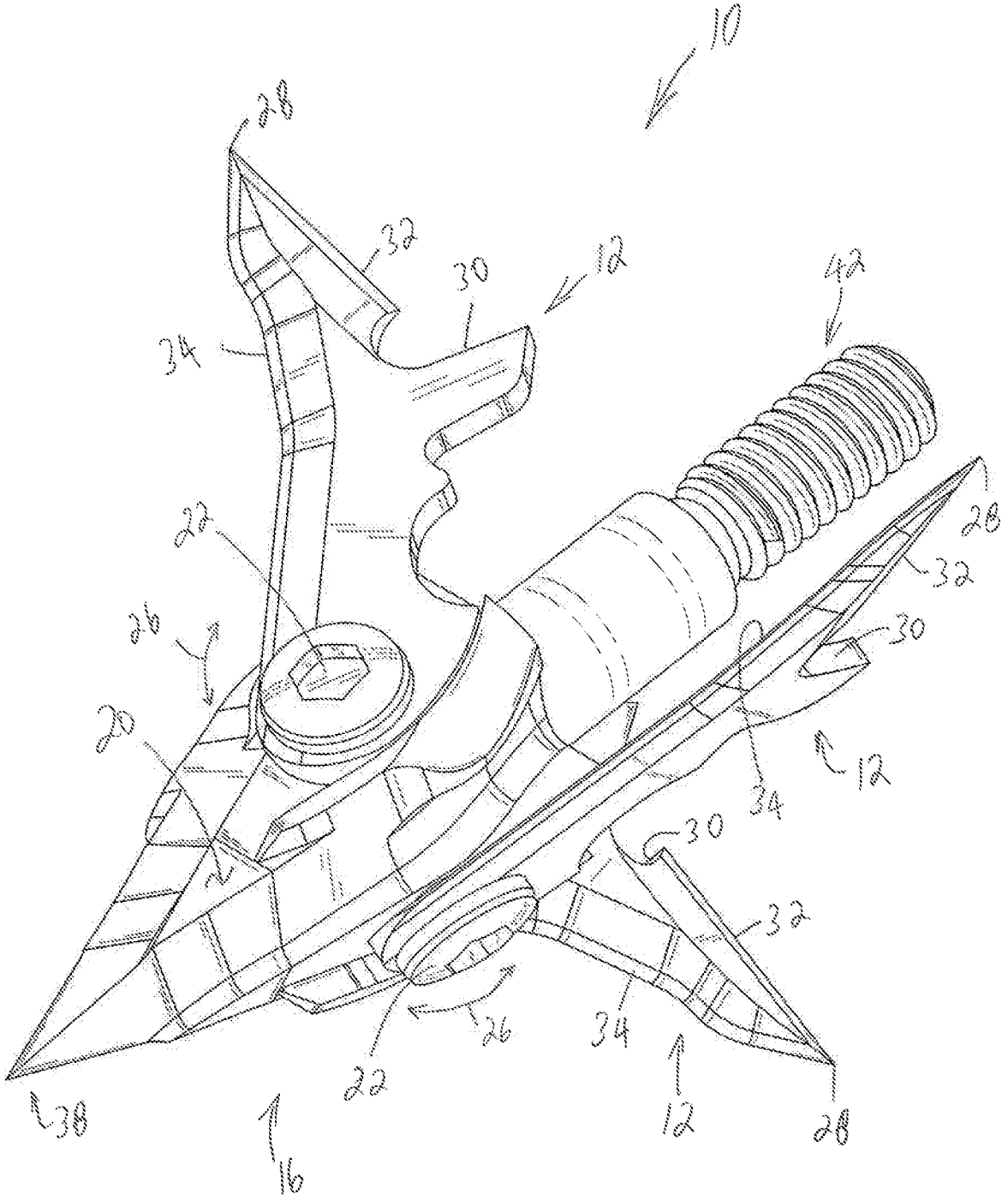
FIG. 1 is a perspective view of a non-limiting exemplary embodiment of a broadhead illustrated with a plurality of blades in a fully deployed configuration.
Figure 2:
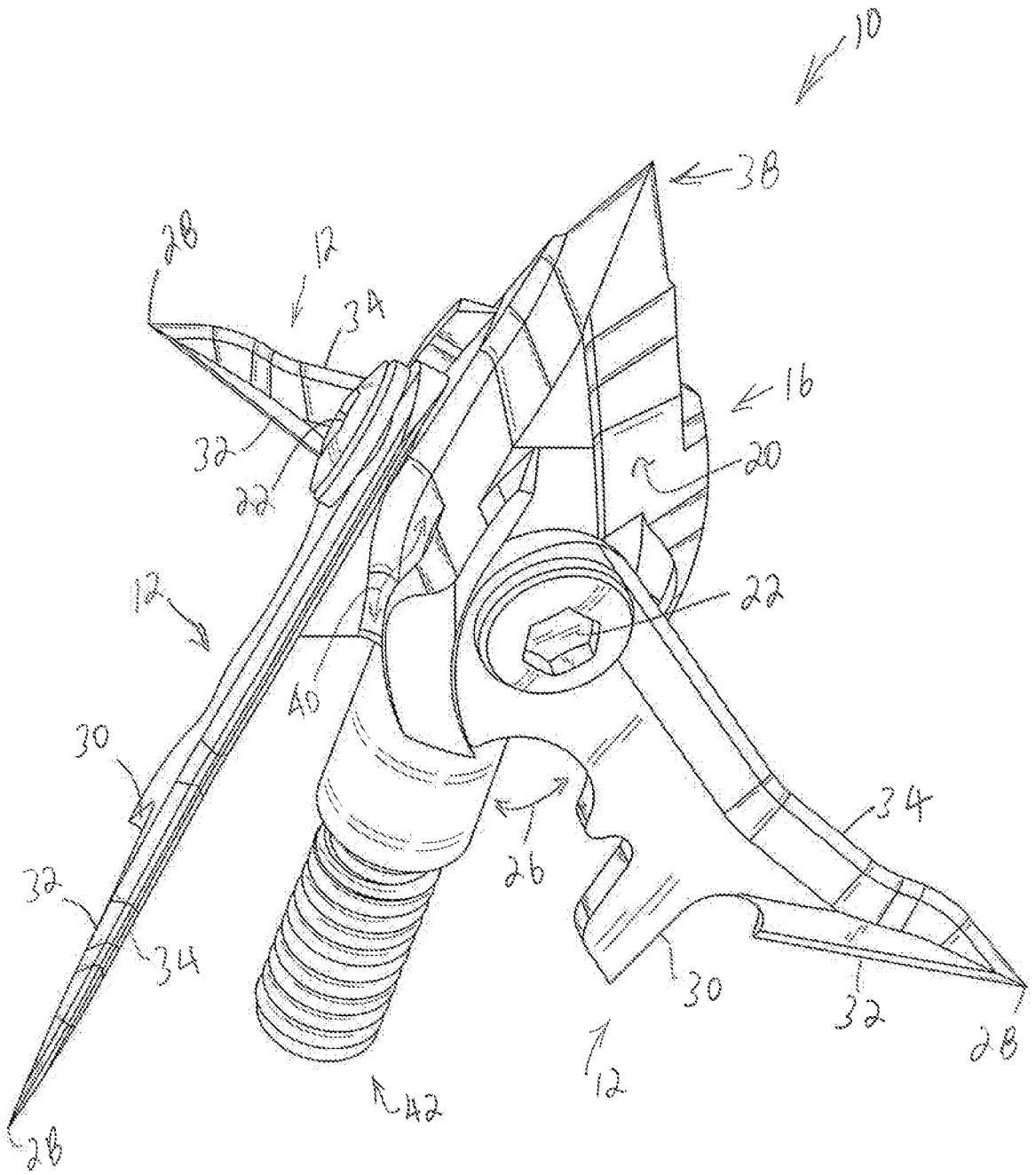
FIG. 2 is another perspective view of the broadhead of FIG. 1.
Figure 3:
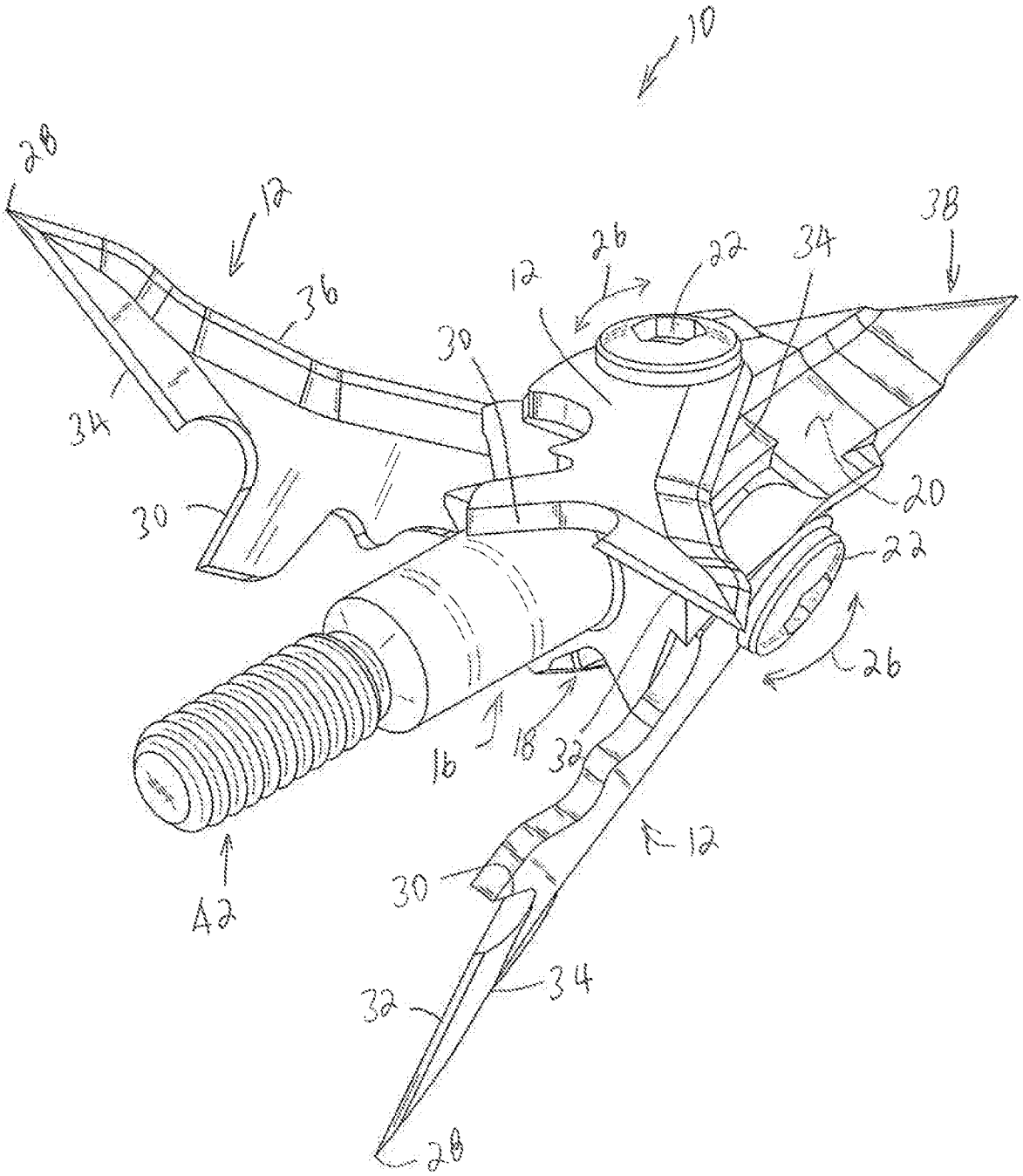
FIG. 3 is another perspective view of the broadhead of FIG. 1.
Figure 4:
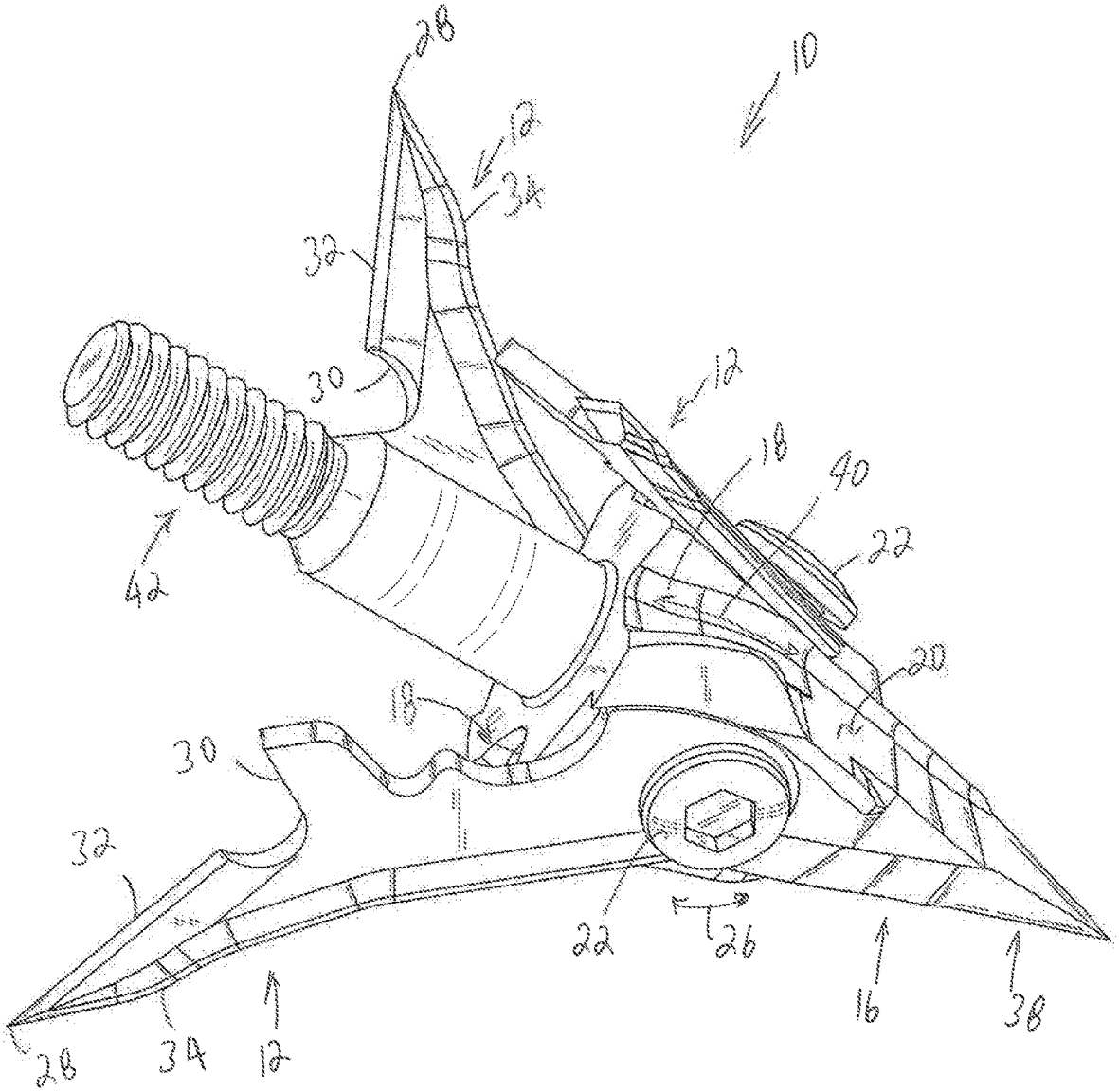
FIG. 4 is another perspective view of the broadhead of FIG. 1.
Figure 5:
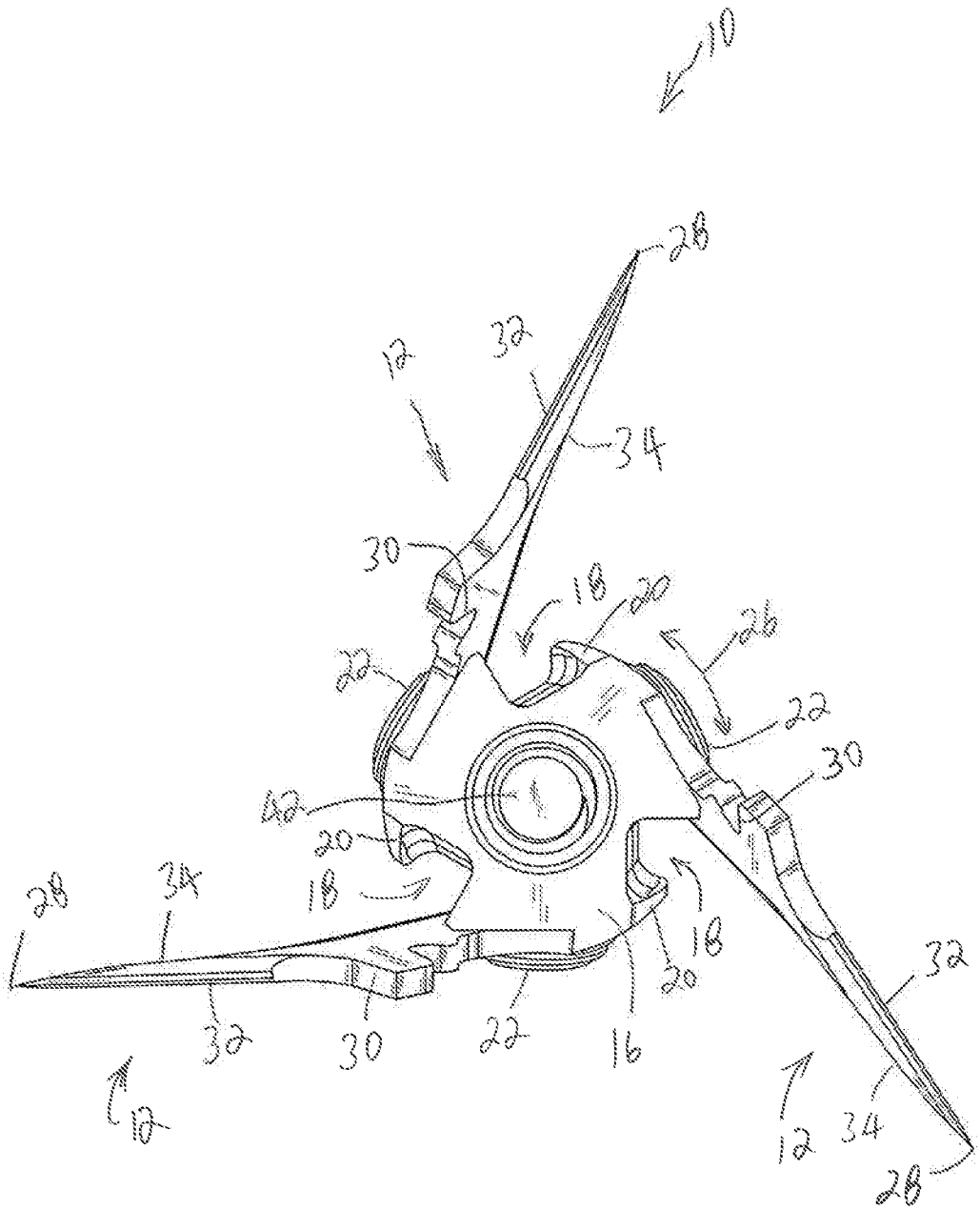
FIG. 5 is an elevation view of the broadhead of FIG. 1 as viewed from a proximal (rear) location.
Figure 6:
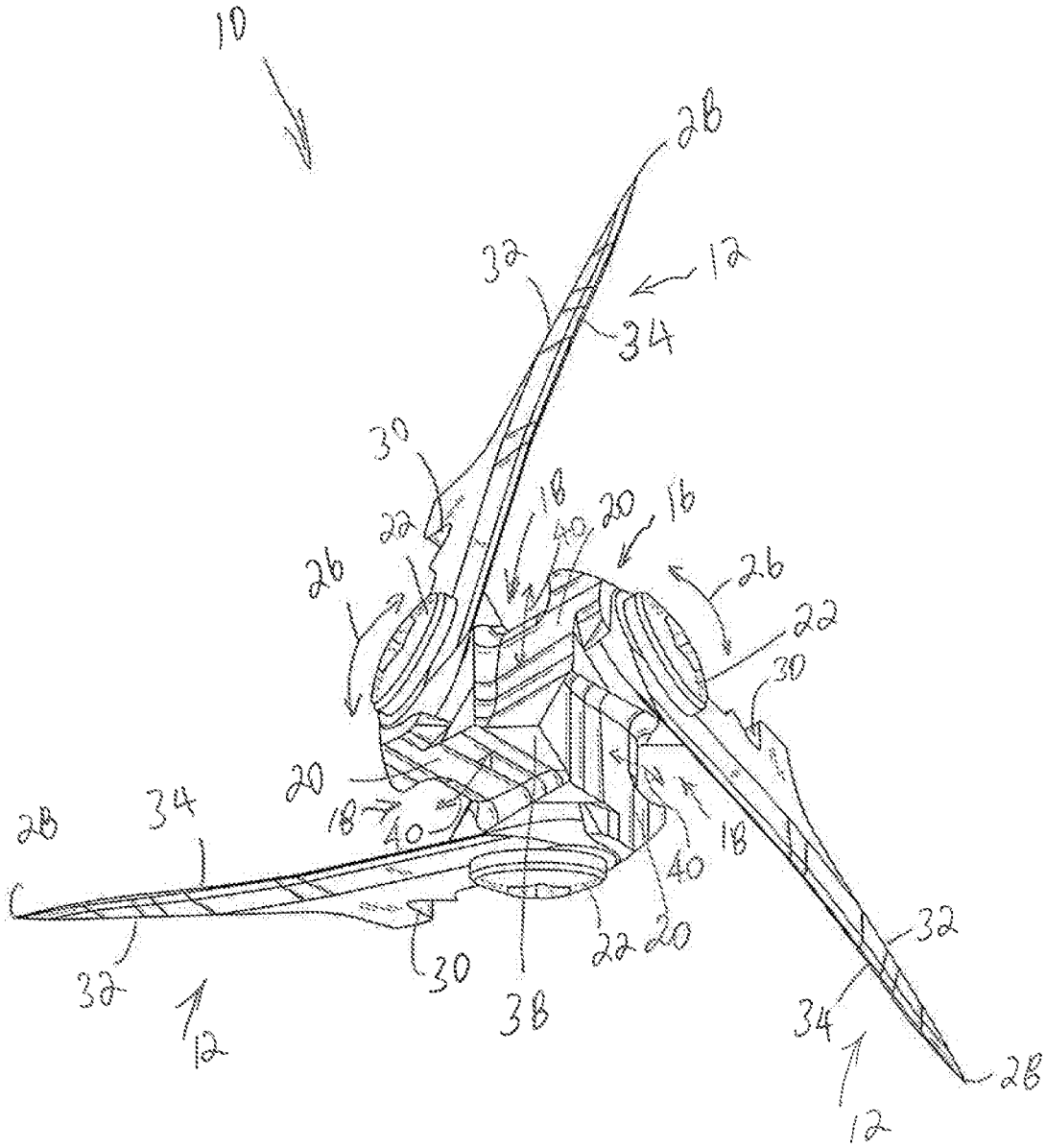
FIG. 6 is an elevation view of the broadhead of FIG. 1 as viewed from a distal (front) location.
Figure 7:
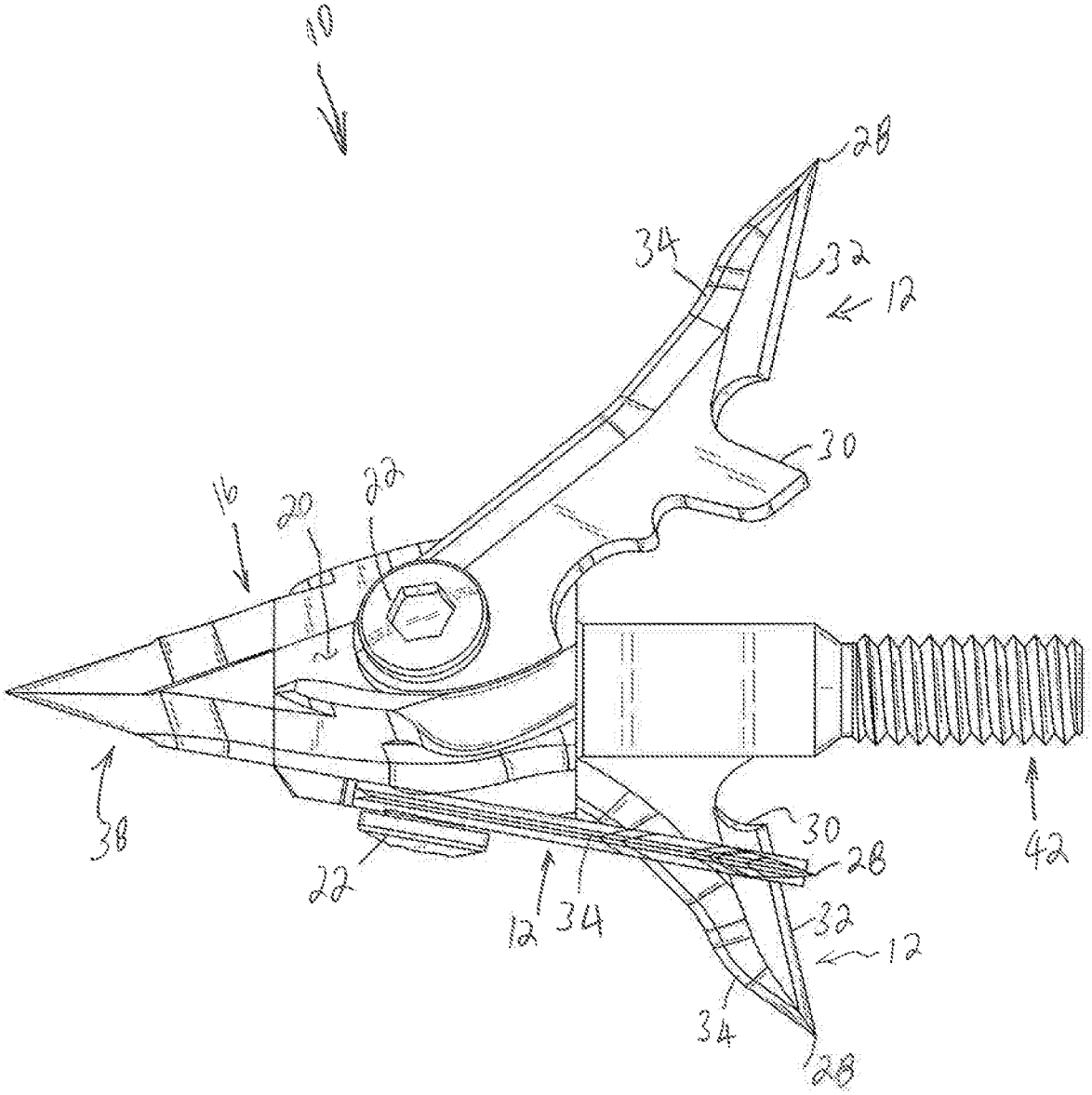
FIG. 7 is a plan view of the broadhead of FIG. 1.
Figure 8:
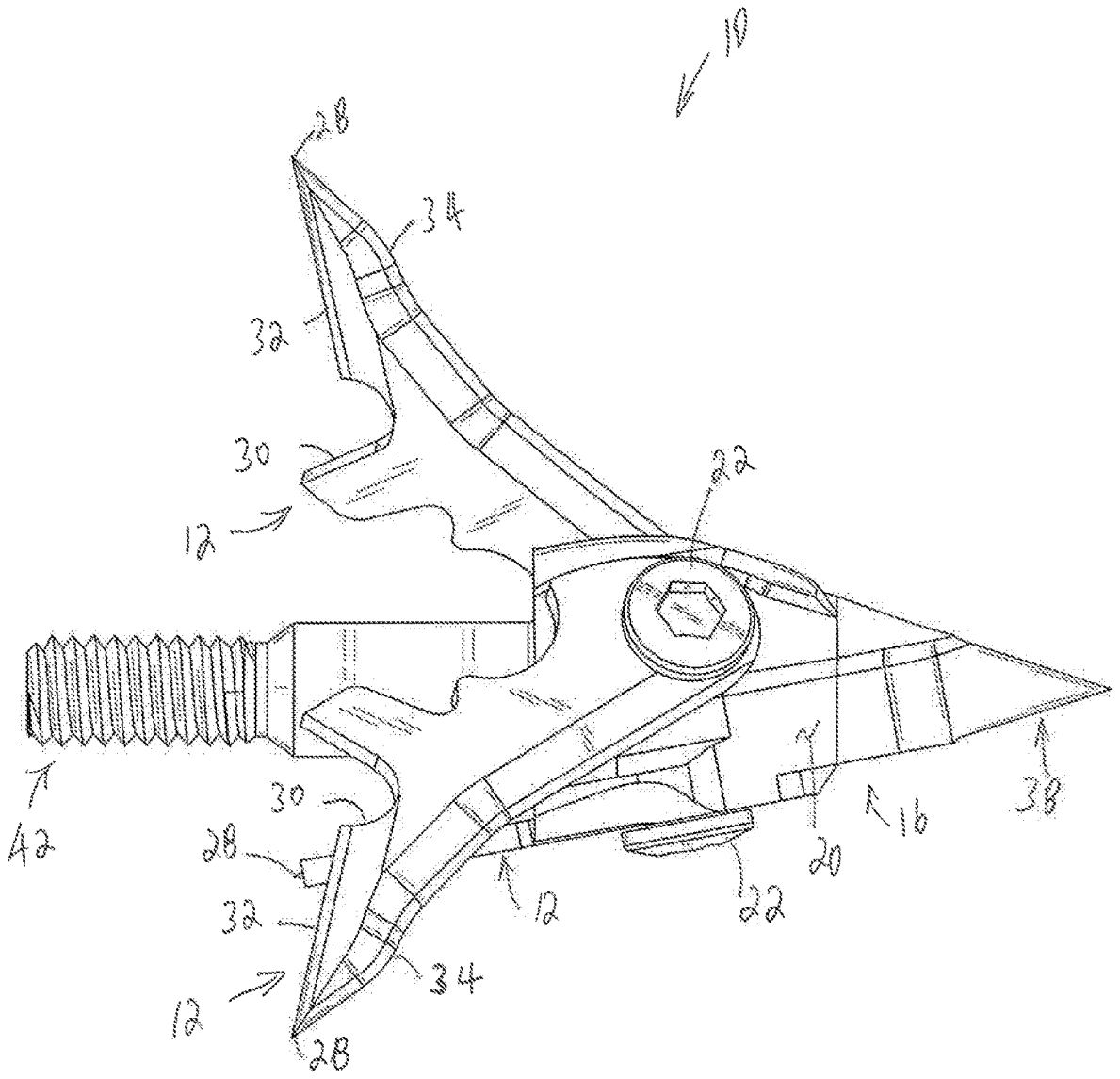
FIG. 8 is another plan view of the broadhead of FIG. 1.
Figure 9:
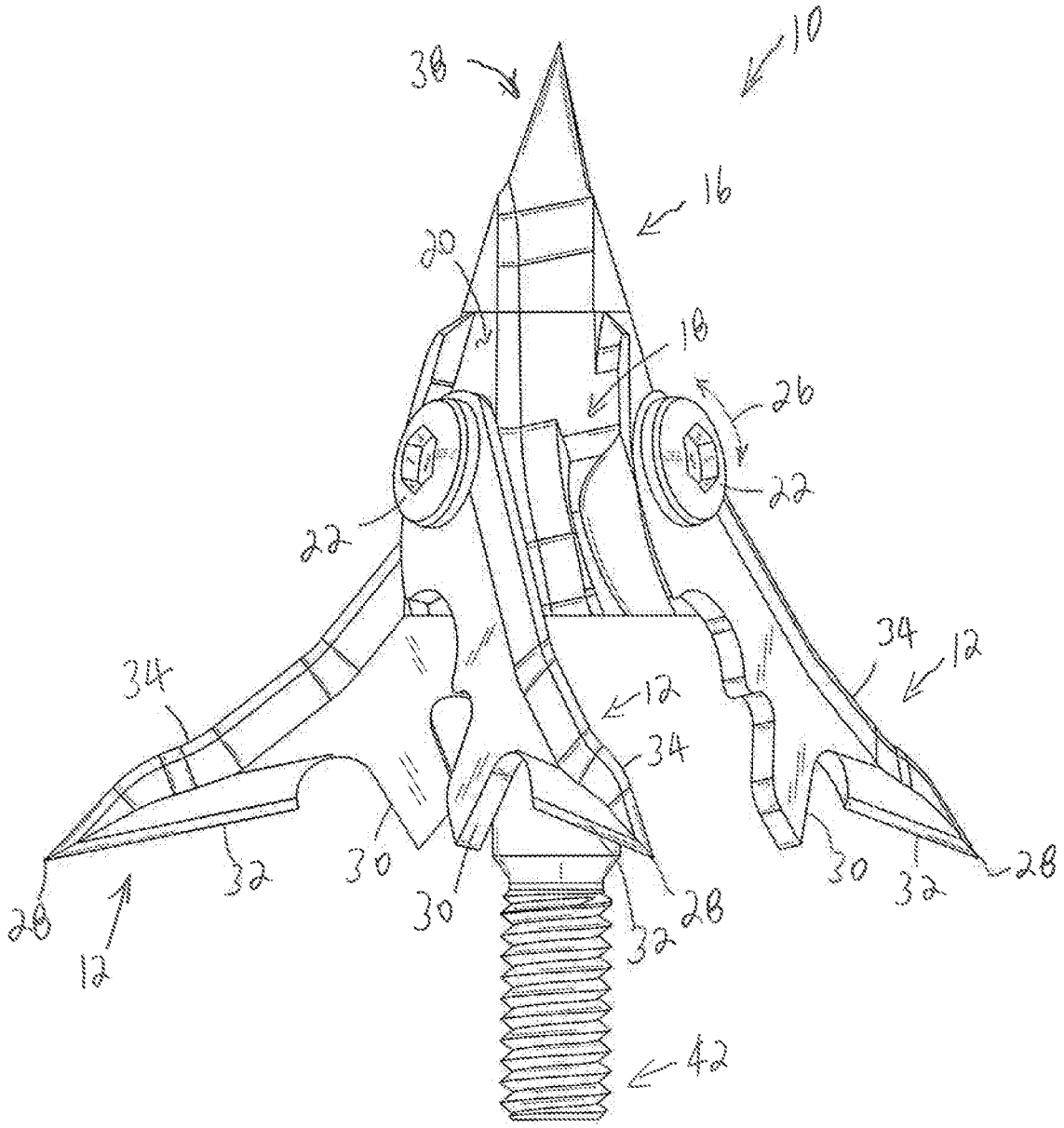
FIG. 9 is another plan view of the broadhead of FIG. 1.
Figure 10:
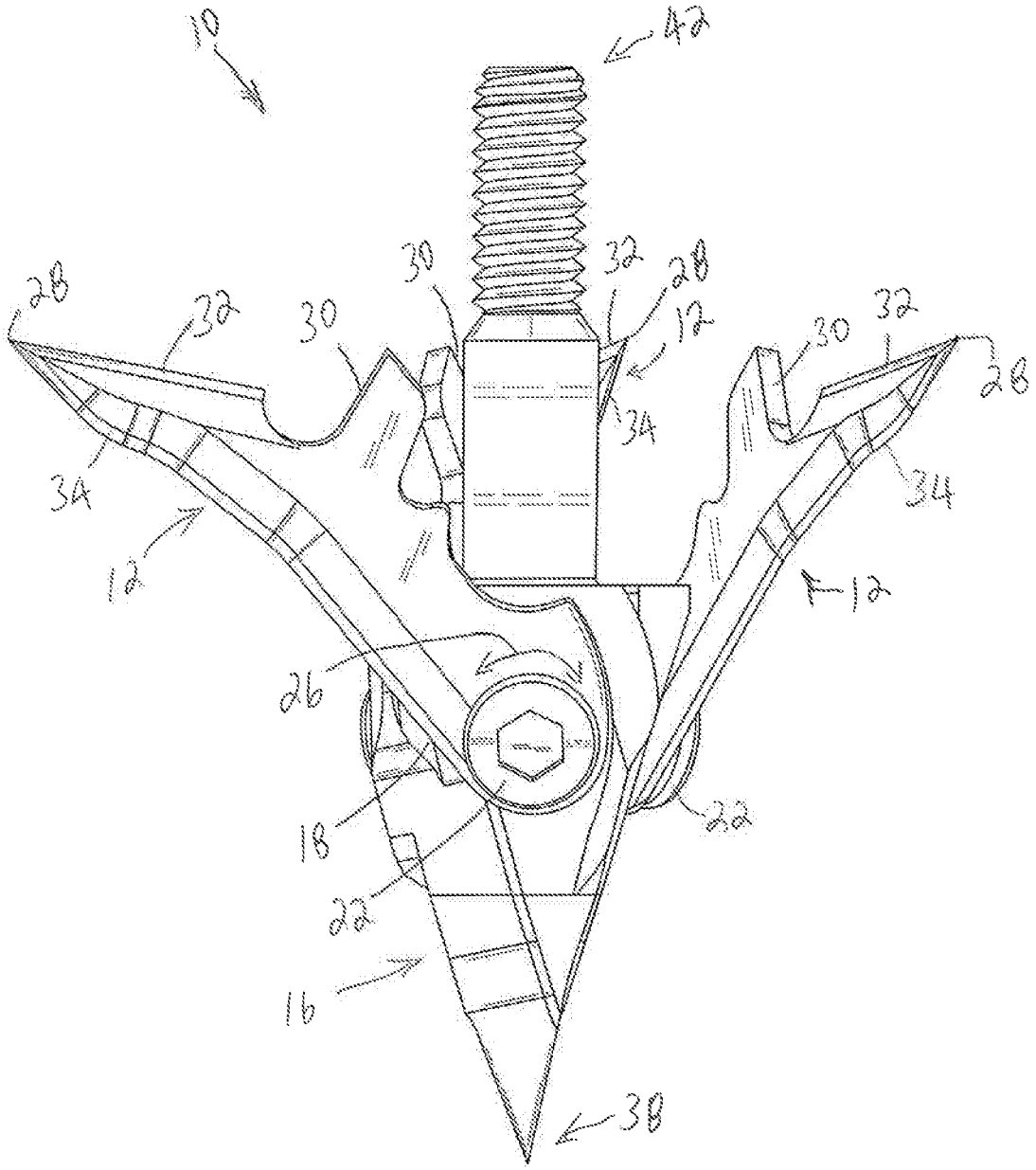
FIG. 10 is another plan view of the broadhead of FIG. 1.
Figure 11:
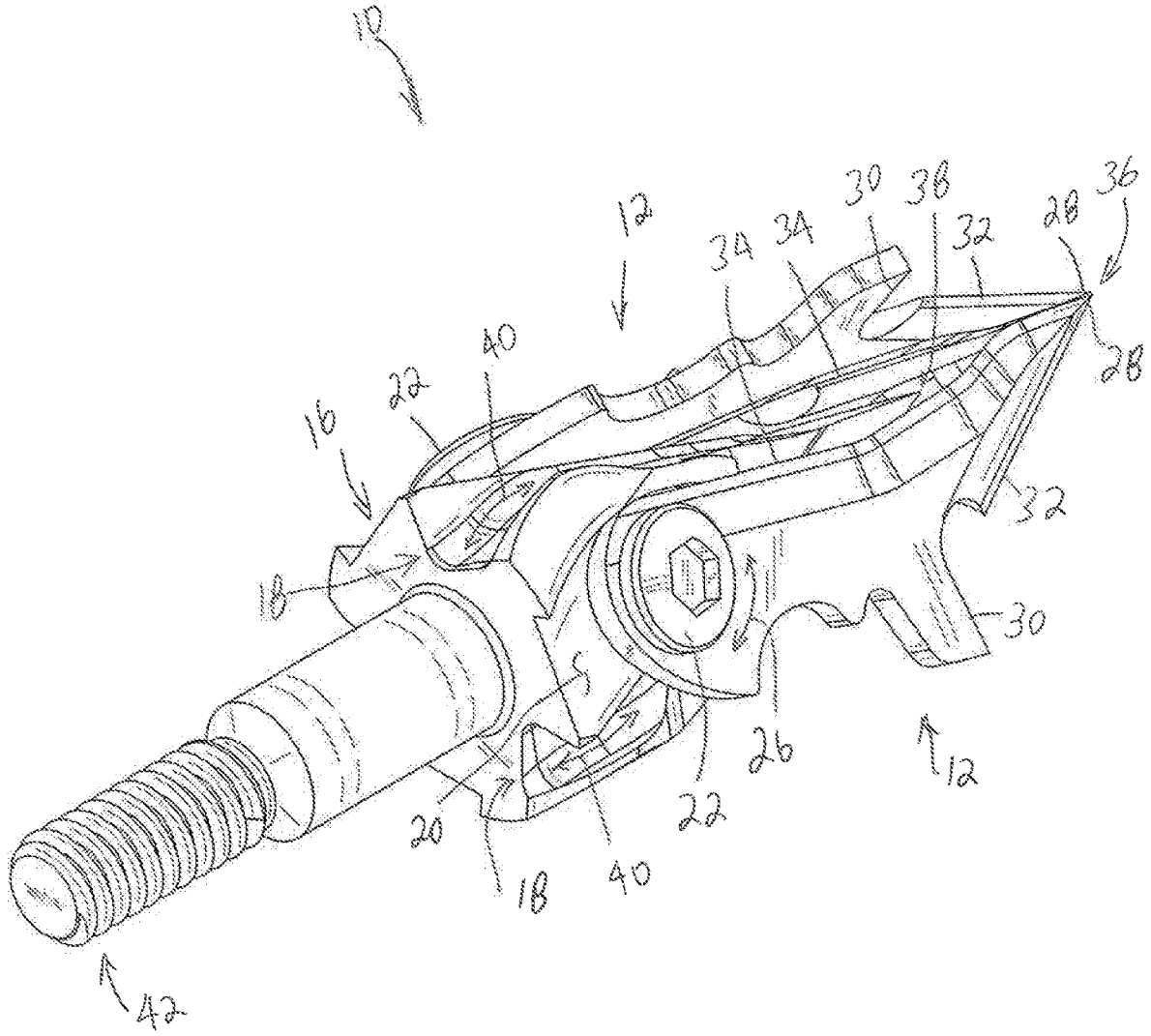
FIG. 11 is a perspective view of the broadhead of FIG. 1 illustrated with the plurality of blades in a fully retracted configuration.
Figure 12:
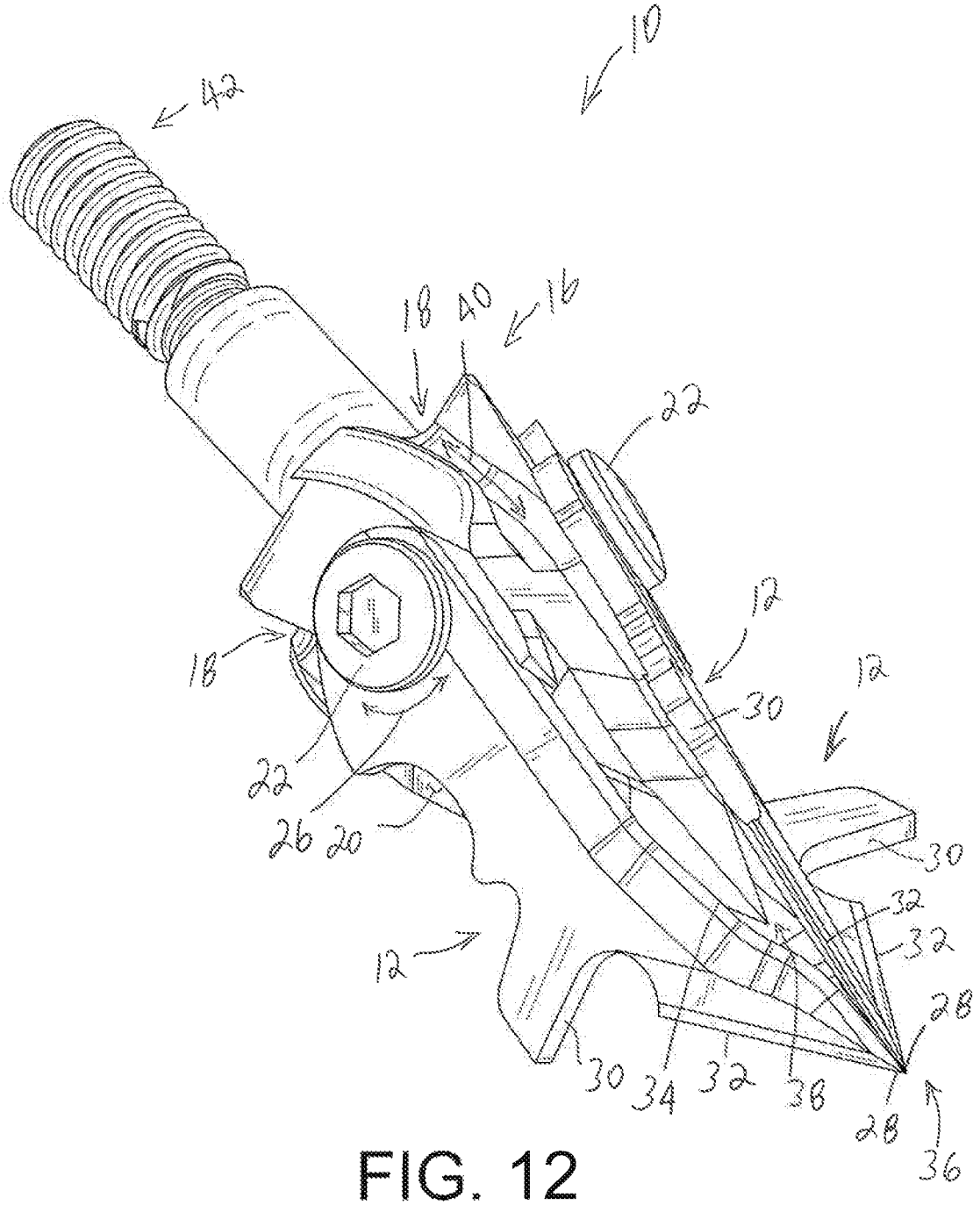
FIG. 12 is another perspective view of the broadhead of FIG. 11.
Figure 13:
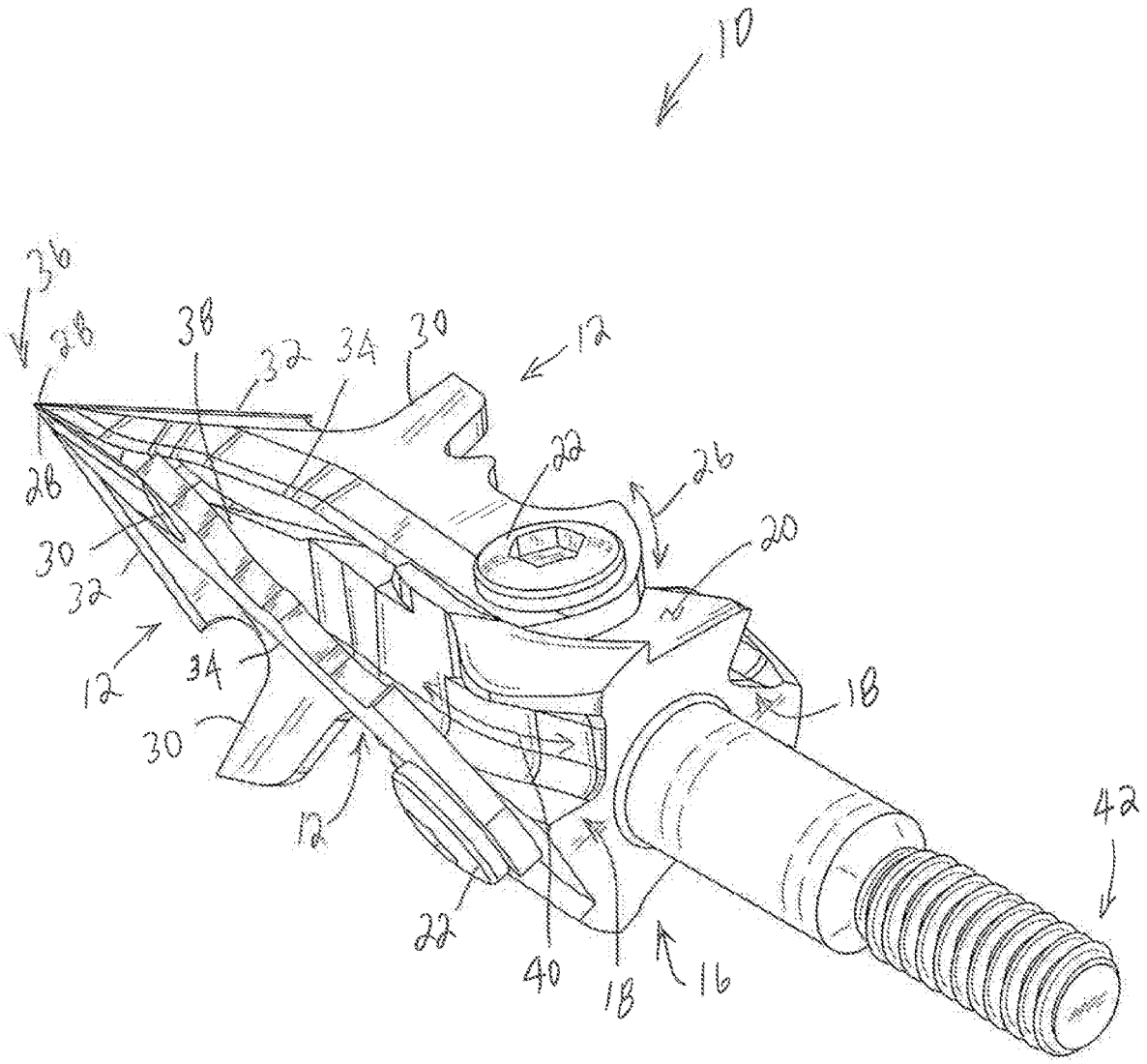
FIG. 13 is another perspective view of the broadhead of FIG. 11.
Figure 14:
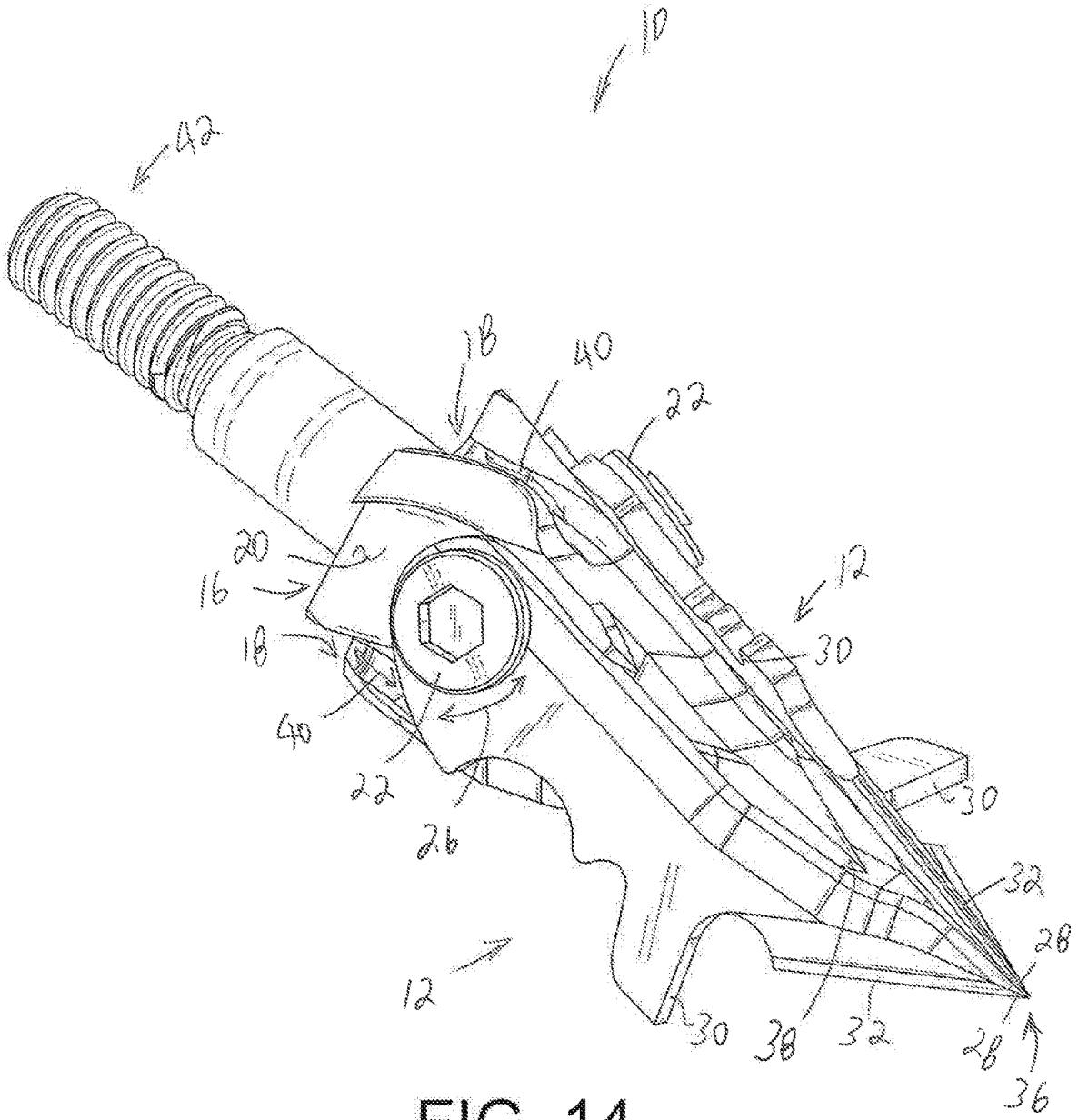
FIG. 14 is another perspective view of the broadhead of FIG. 11.

FIGS. 1-10 are various views of a non-limiting exemplary embodiment of a broadhead 10 of the instant disclosure illustrated with a plurality of blades 12 in a fully deployed configuration. FIGS. 1-4 are perspective views of the broadhead 10 as viewed from different vantage points. For instance, FIGS. 1 and 2 are front perspective views of the broadhead 10 as viewed from above and below. Likewise, FIGS. 3 and 4 are rear perspective views of the broadhead 10 as viewed from above and below. FIGS. 5 and 6, respectively, are the elevational views of the broadhead 10 as viewed from the rear and the front. FIGS. 7-10 are plan views of the broadhead 10 in different orientations about a longitudinal axis of the broadhead 10. For instance, FIGS. 7-9 illustrate the broadhead 10 in different orientations about the longitudinal axis such that only two of the plurality of blades 12 are viewable or visible with the other blade being "underneath" (or "hidden under") the broadhead 10. In contrast, FIG. 10 illustrates the broadhead 10 oriented about the longitudinal axis such that all of the plurality of blades 12 are visible or viewable when looking down along a plane of the blade 12 extending out of the paper.

Figure 15:
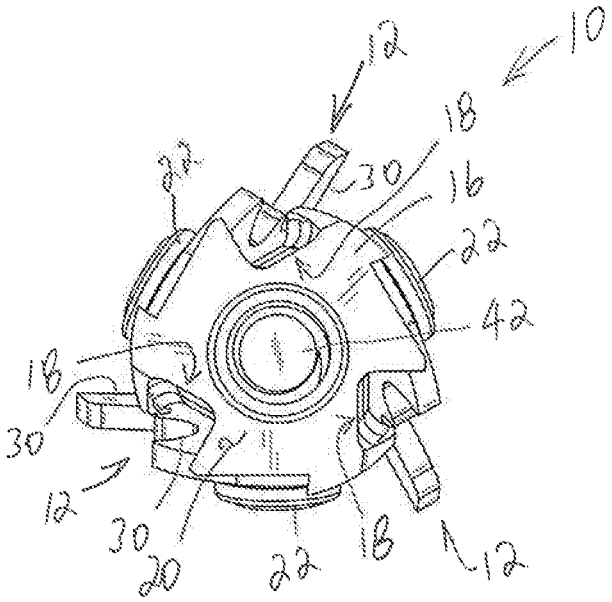
FIG. 15 is an elevation view of the broadhead of FIG. 11 as viewed from the proximal (rear) location.
Figure 16:
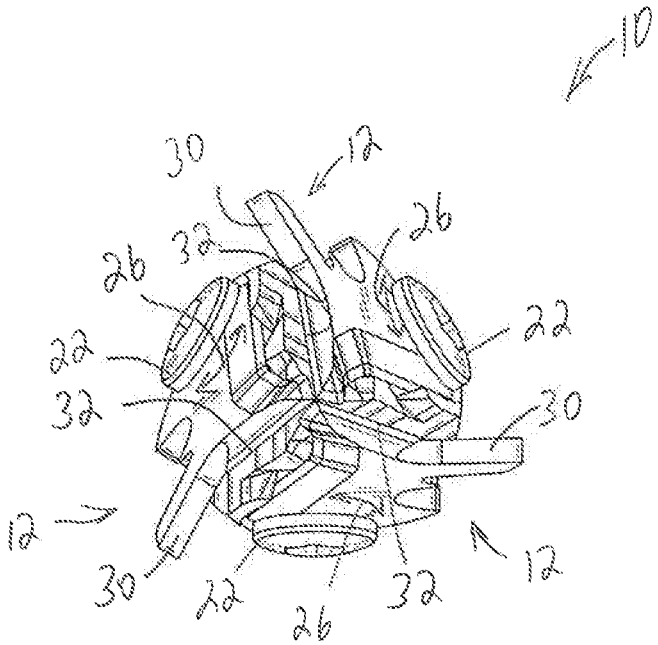
FIG. 16 is an elevation view of the broadhead of FIG. 11 as viewed from the distal (front) location.
Figure 17:
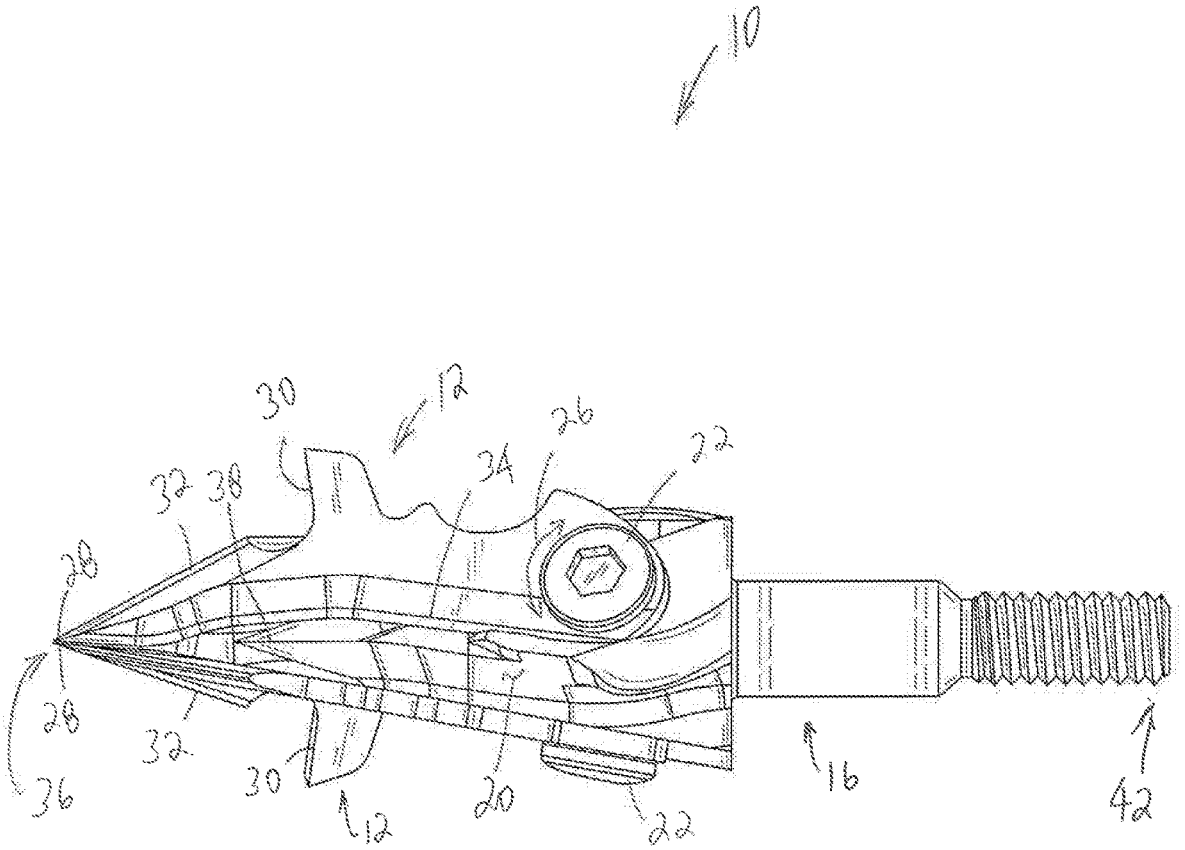
FIG. 17 is a plan view of the broadhead of FIG. 11.
Figure 18:
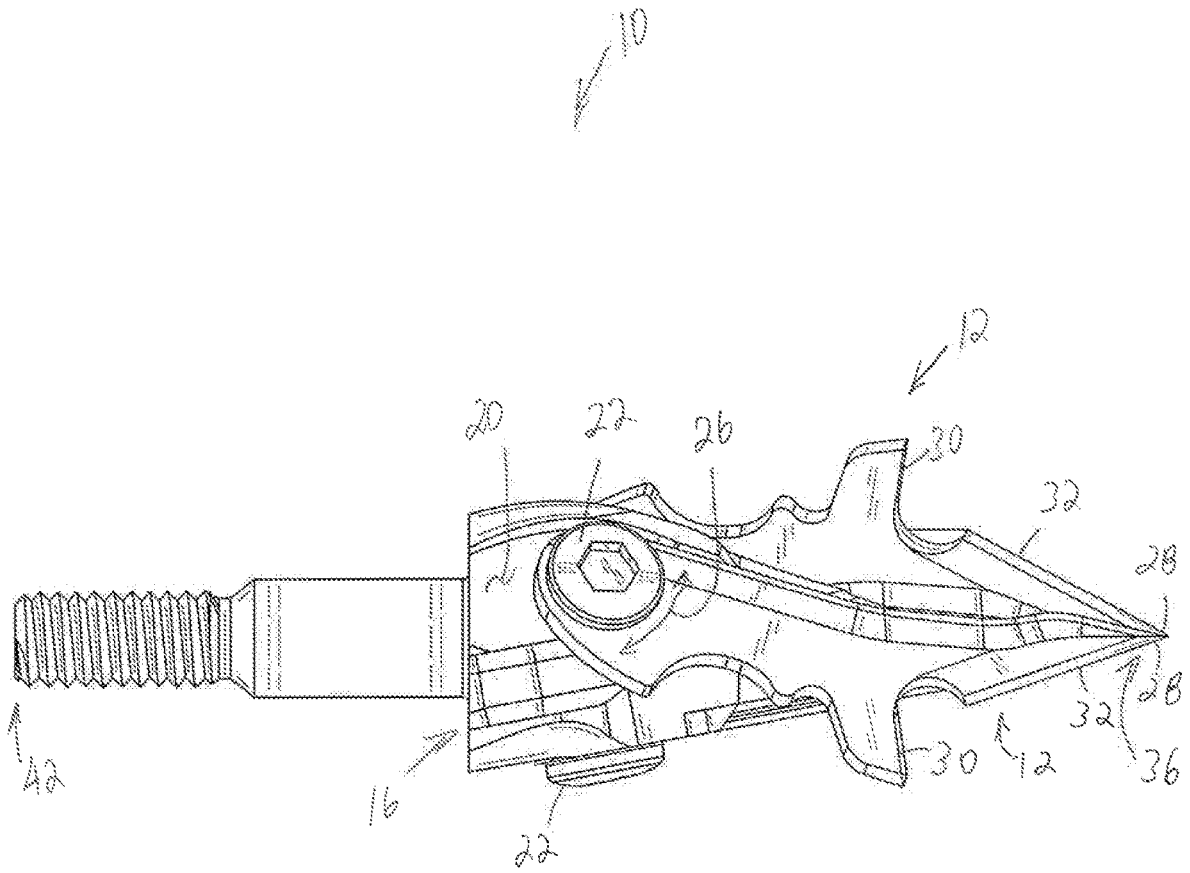
FIG. 18 is another plan view of the broadhead of FIG. 11.
Figure 19:
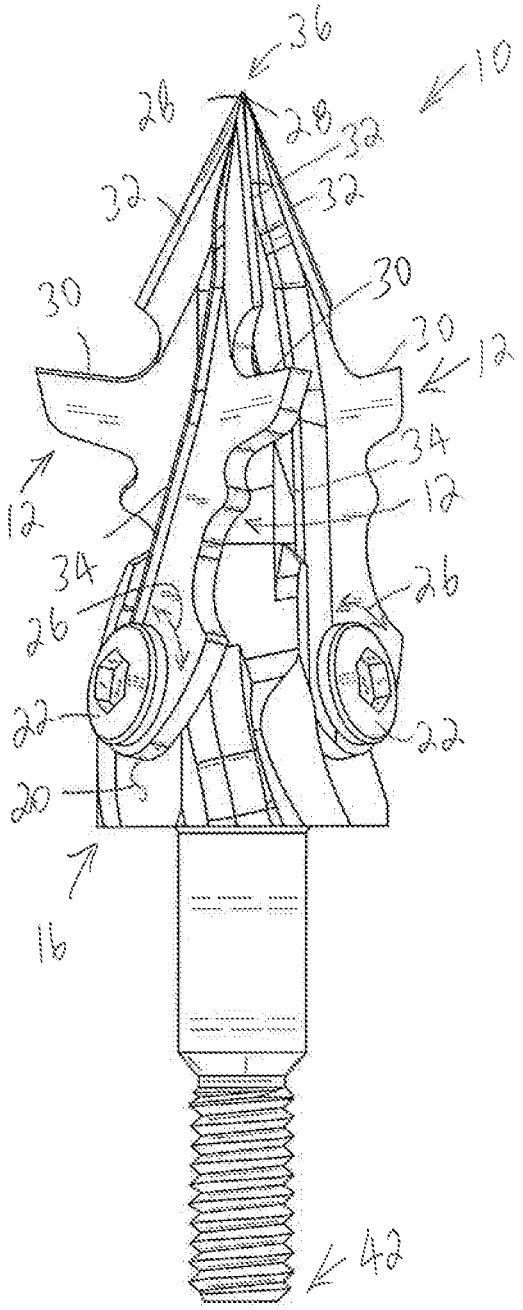
FIG. 19 is another plan view of the broadhead of FIG. 11.
Figure 20:
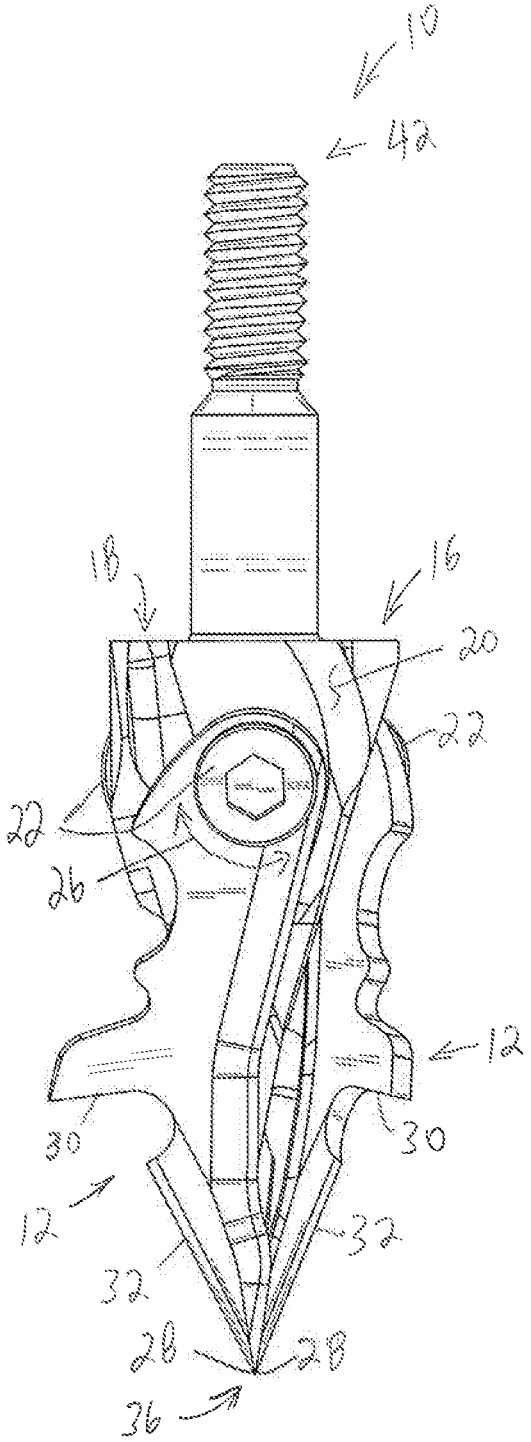
FIG. 20 is another plan view of the broadhead of FIG. 11.

FIGS. 11-20 are various views of the broadhead 10 illustrated with the plurality of blades 12 in a fully retracted configuration such as for example during flight. FIGS. 11-14 are perspective views of the broadhead 10 as viewed from different vantage points. FIGS. 15 and 16, respectively, are the elevational views of the broadhead 10 as viewed from the rear and the front. FIGS. 17-20 are plan views of the broadhead 10 in different orientations about the longitudinal axis of the broadhead 10.

Figure 21:
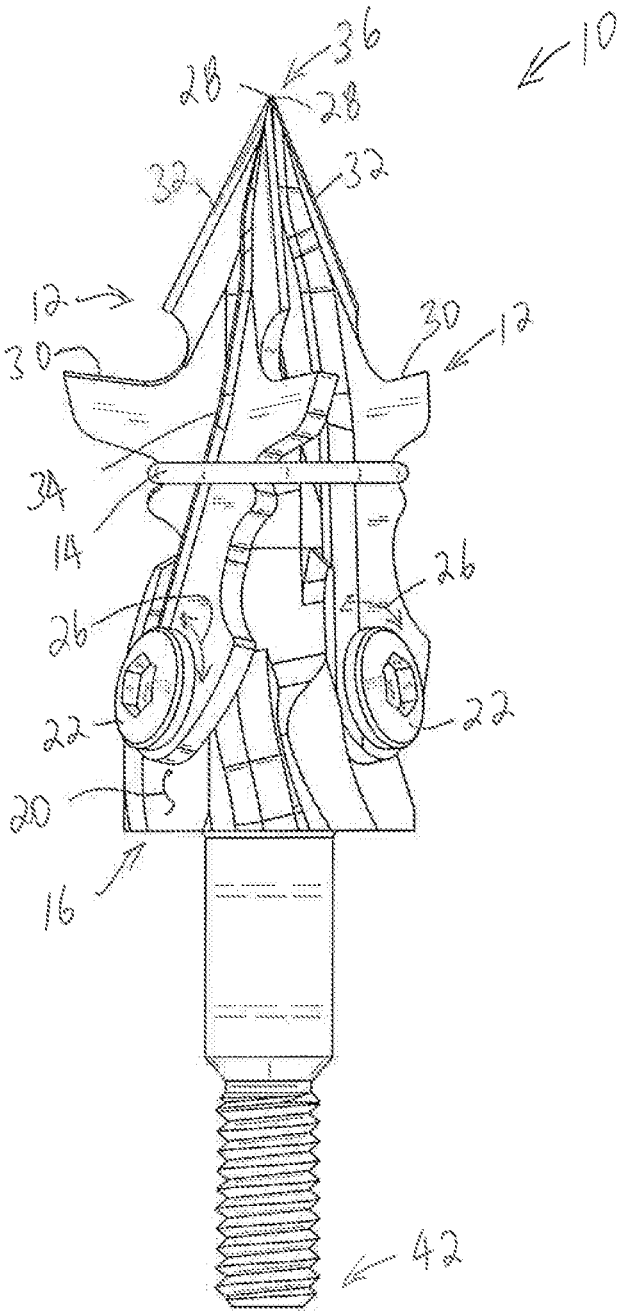
FIG. 21 is a plan view of the broadhead of FIG. 11 having a non-limiting exemplary embodiment of a collar configured for retaining the blades in the fully retracted configuration.
Figure 22:
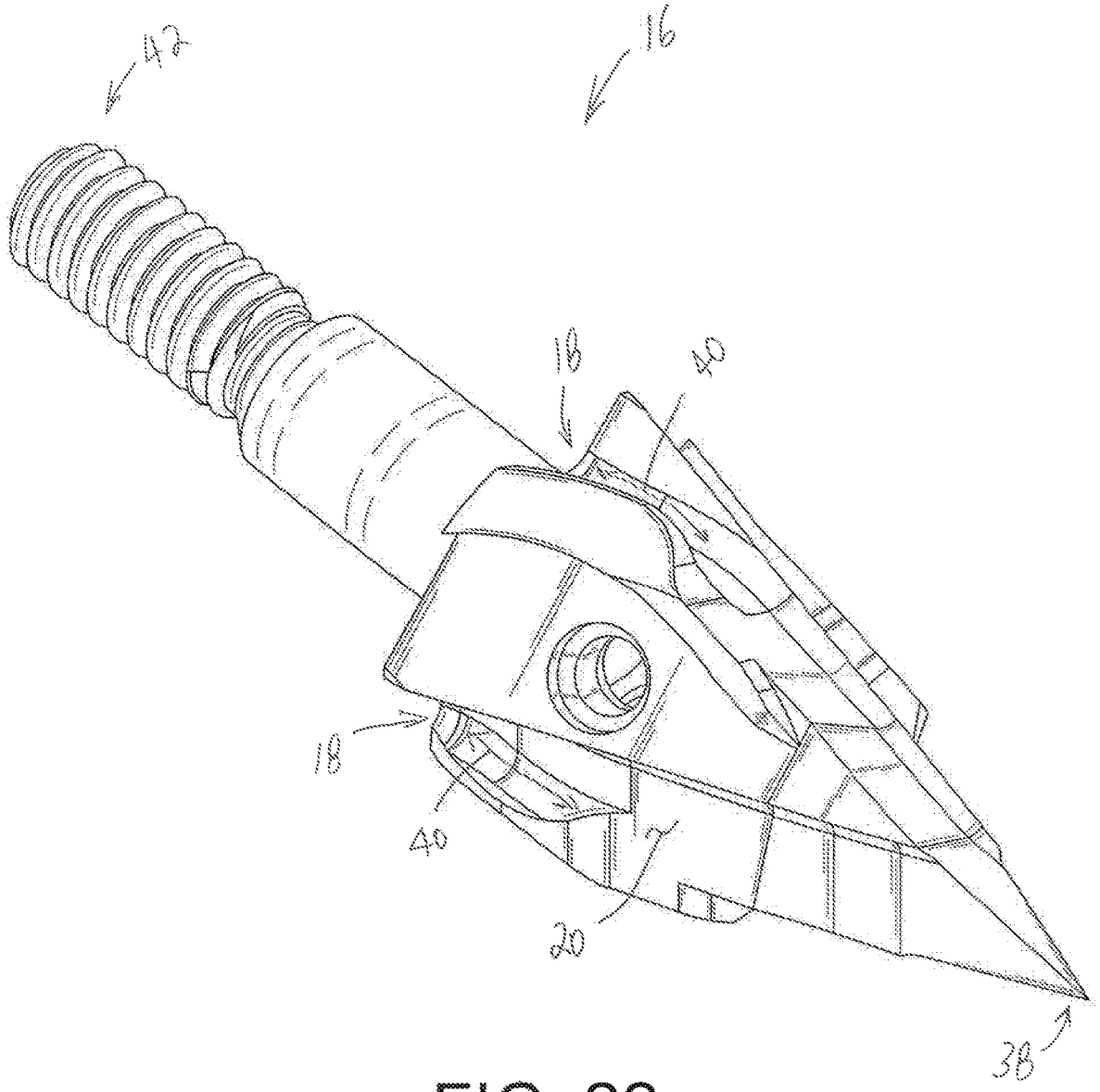
FIG. 22 is a perspective view of a non-limiting exemplary embodiment of a ferrule for the broadhead of FIG. 1.
Figure 23:
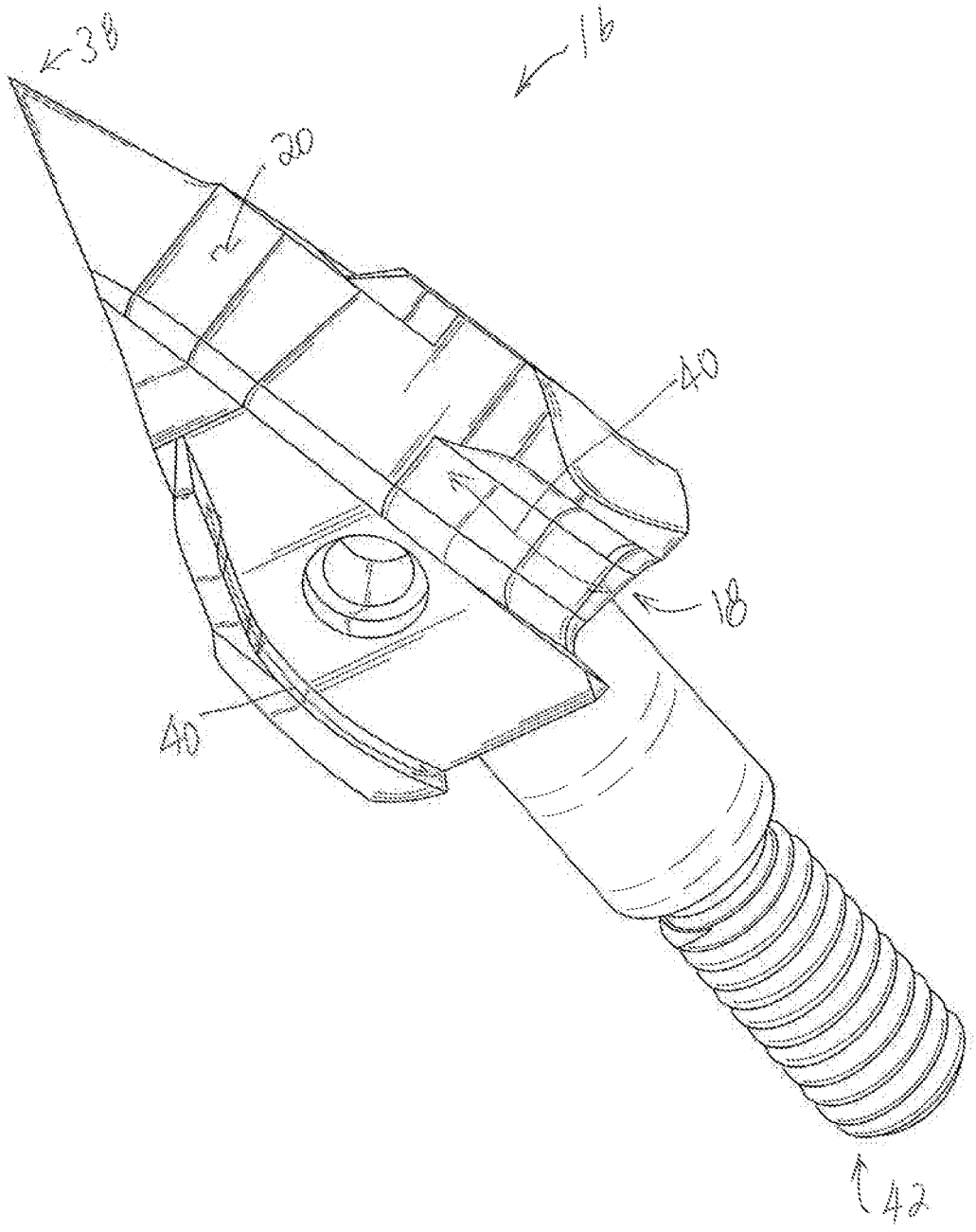
FIG. 23 is another perspective view of the ferrule of FIG. 22.
Figure 24:
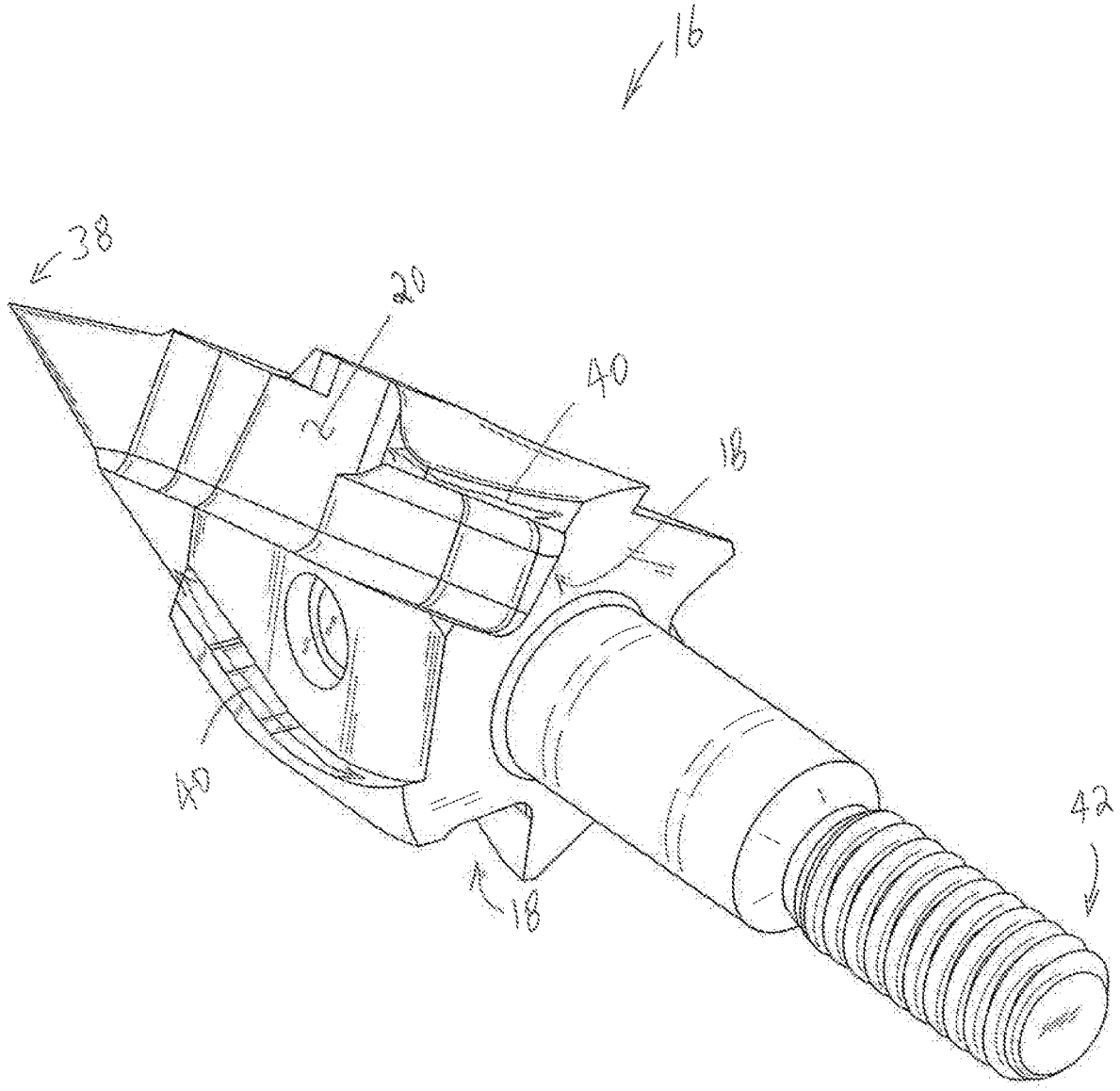
FIG. 24 is another perspective view of the ferrule of FIG. 22.
Figure 25:
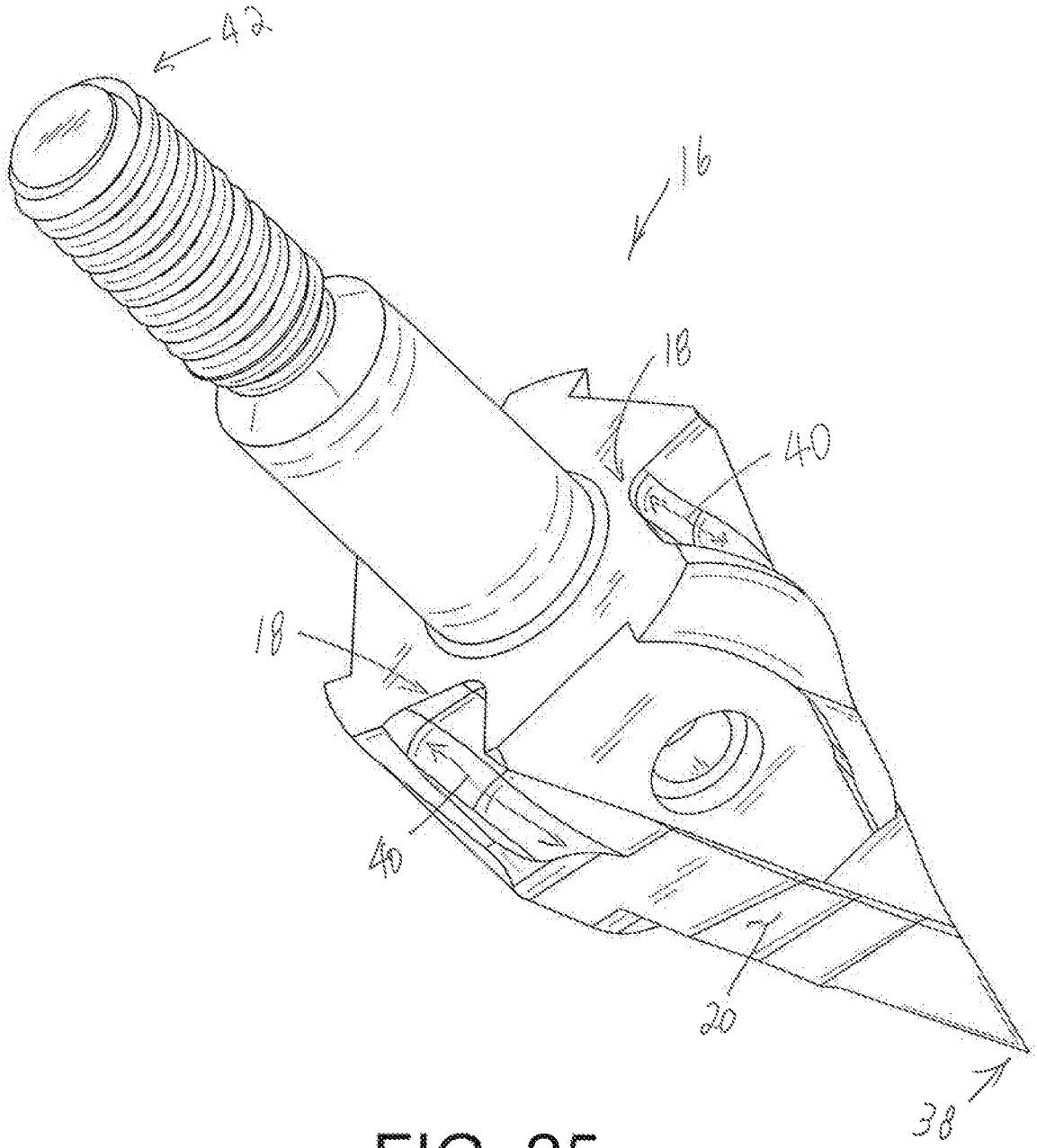
FIG. 25 is another perspective view of the ferrule of FIG. 22.

FIG. 21 illustrates the broadhead 10 of FIGS. 11-20 having a non-limiting exemplary embodiment of a collar 14 encircling at least a portion of each of the plurality of blades 12. In some embodiments, as will be described in detail infra, the collar 14 is configured for retaining the plurality of blades 12 in the retracted configuration such as for example during flight.

Figure 26:
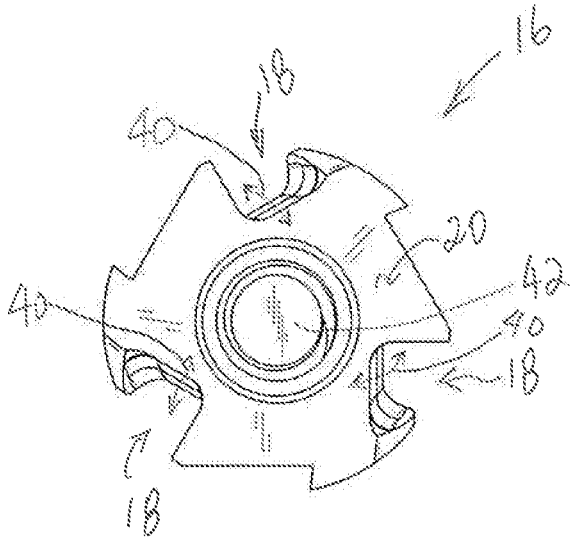
FIG. 26 is an elevation view of the ferrule of FIG. 22 as viewed from the proximal (rear) location.
Figure 27:
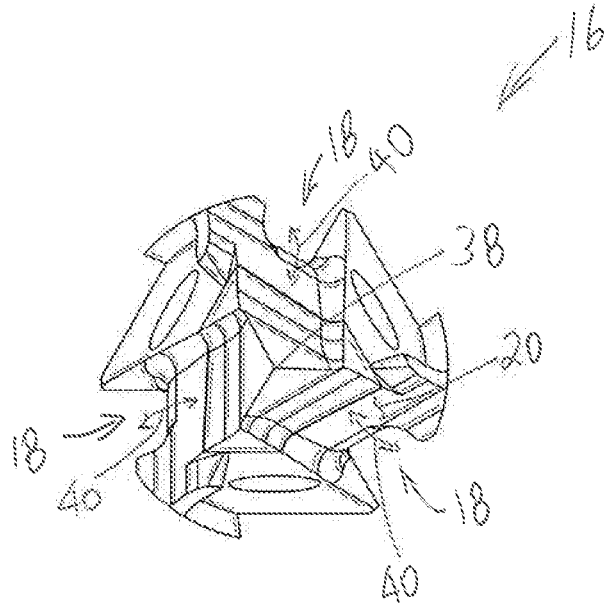
FIG. 27 is an elevation view of the ferrule of FIG. 22 as viewed from the distal (front) location.
Figure 28:
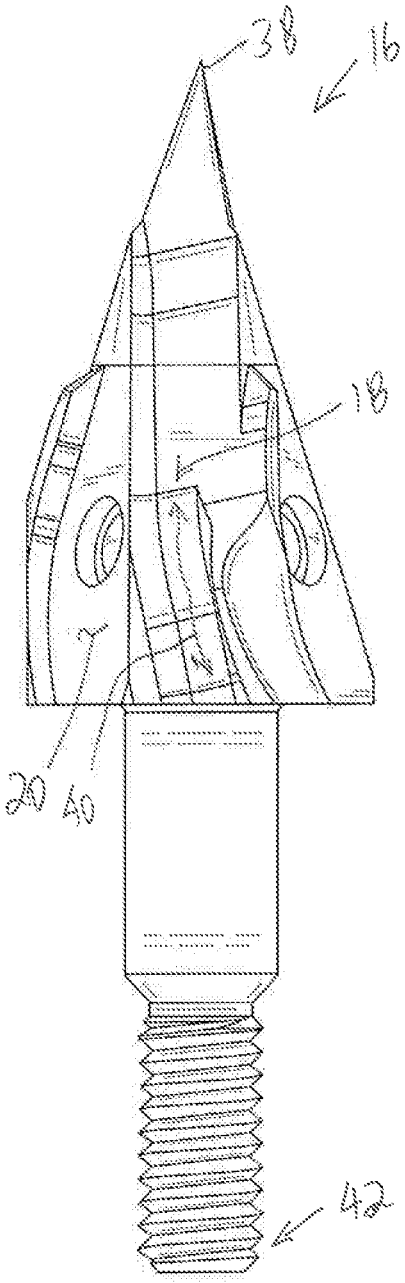
FIG. 28 is a plan view of the ferrule of FIG. 22.
Figure 29:
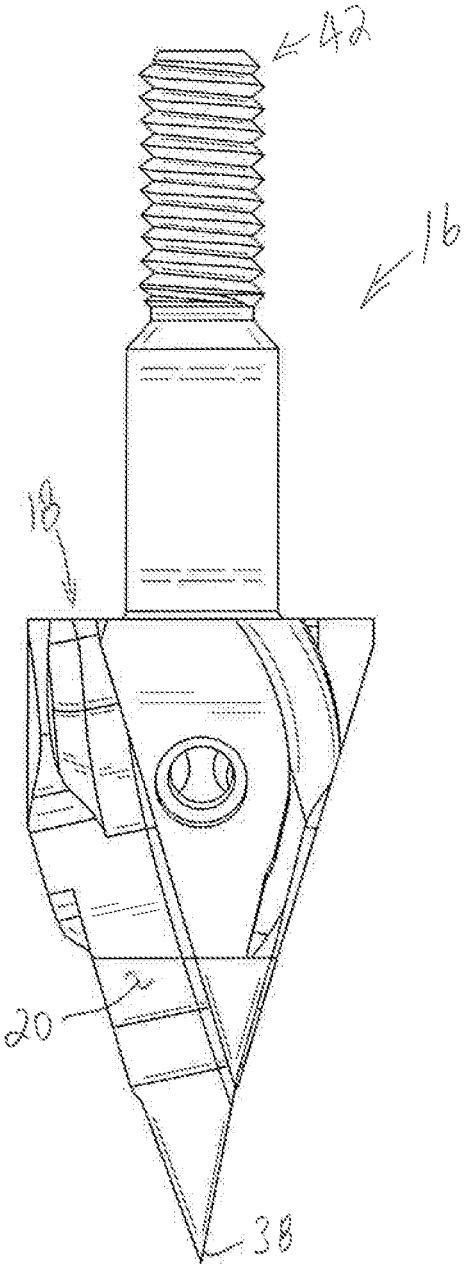
FIG. 29 is another plan view of the ferrule of FIG. 22.

FIGS. 22-29 illustrate various views of a non-limiting exemplary embodiment of a ferrule 16 for the broadhead 10. FIGS. 22-25 are perspective views of the ferrule 16 as viewed from different vantage points. FIGS. 26 and 27, respectively, are the elevational views of the ferrule 16 as viewed from the rear and the front. FIGS. 28 and 29 are plan views of the ferrule 16 in different orientations about a longitudinal axis of the ferrule 16 (i.e., about the longitudinal axis of the broadhead 10).

Figure 30:
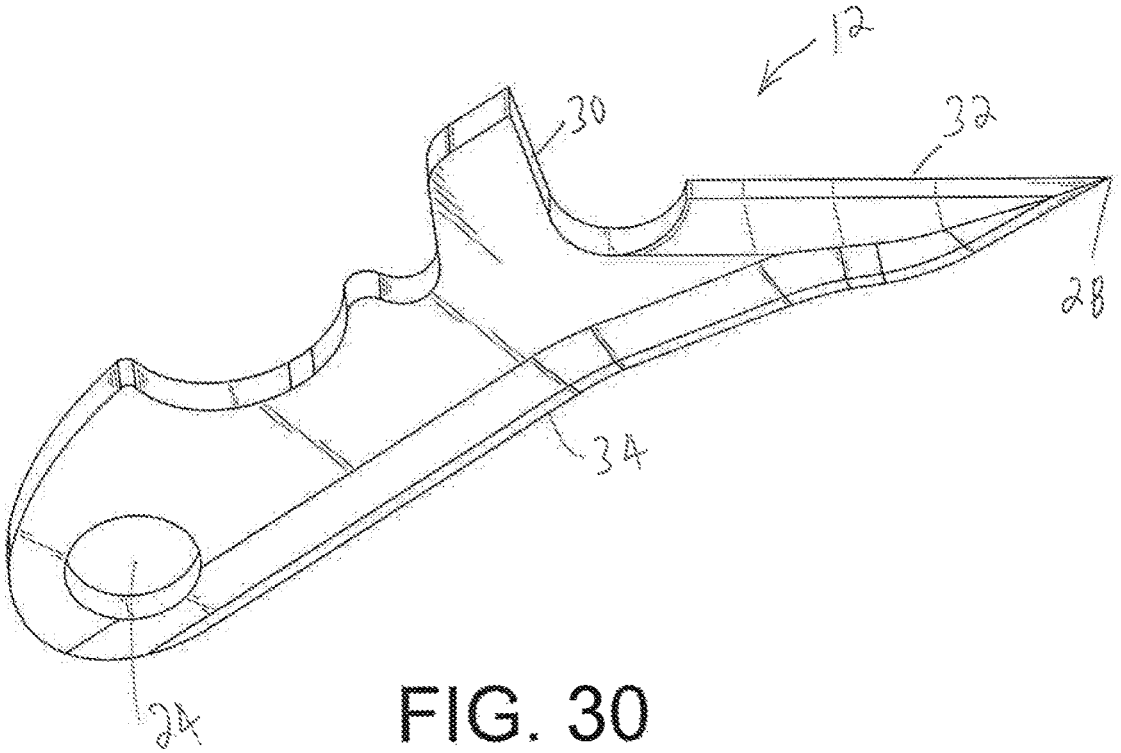
FIG. 30 is a perspective view of a non-limiting exemplary embodiment of a blade for the broadhead of FIG. 1.
Figure 31:
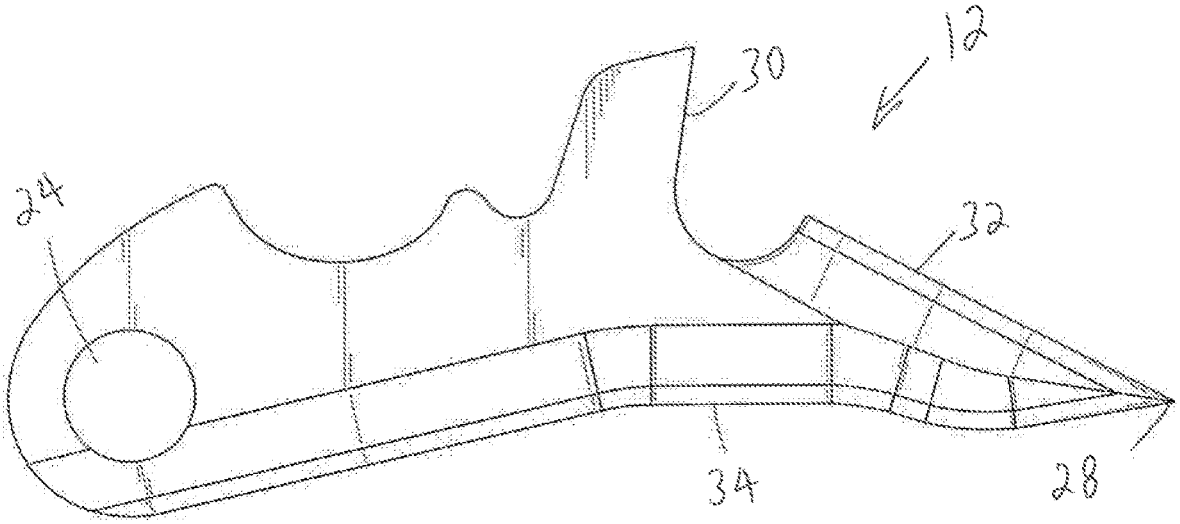
FIG. 31 is a plan view of the blade of FIG. 30.

FIGS. 30 and 31, respectively, are a perpective view and a plan view of a non-limiting exemplary embodiment of one of the plurality of blades 12 for the broadhead 10.

In a non-limiting exemplary embodiment, the broadhead 10 includes the plurality of blades 12, the ferrule 16, and a plurality of channels 18 disposed on at least a portion of a surface 20 of the ferrule 16.

In a non-limiting exemplary embodiment, each blade 12 of the plurality of blades is rotatably coupled to the surface 20 of the ferrule 16. In a non-limiting exemplary embodiment, each blade 12 of the plurality of blades is rotatably or pivotally coupled to the surface 20 of the ferrule 16 with a fastener or a dowel 22 extending through an opening 24 in each blade 12. In some embodiments, the fastener or dowel 22 can be a pivot pin or any other mechanism known in the art for rotatably coupling the blades 12 and the surface 20 such that the blades 12 are not hindered during rotation. Accordingly, the plurality of blades 12 are configured to rotate unhindered between the fully retracted in-flight configuration and the fully extended swept-back configuration. In a non-limiting exemplary embodiment, the plurality of blades rotate tangentially relative to the surface 20 of the ferrule such as for instance illustrated by the directional arrow 26.

In a non-limiting exemplary embodiment, each blade 12 includes a tip 28, an impact shoulder 30, a first cutting edge 32, and a second cutting edge 34. In some embodiments, the first cutting edge 32 extends between the tip 28 and a location proximate the impact shoulder 30. However, this extent or size or length of the first cutting edge 32 should not be construed as a limitation or a requirement. In certain embodiments, the first cutting edge 32 may extend only a portion of the distance between the tip 28 and the impact shoulder 30. In some embodiments, the first cutting edge 32 may extend the entire distance between the tip 28 and the impact shoulder 30. In certain embodiments, the second cutting edge 34 extends from the tip 28 to proximate the opening 24 in the blade 12. However, this extent or size or length of the second cutting edge 34 should not be construed as a limitation or a requirement. In some embodiments, the second cutting edge 34 may extend only a portion of the distance between the tip 28 and the opening 24. In certain embodiments, the second cutting edge 34 may extend the entire distance from the tip 28.

In a non-limiting exemplary embodiment, the collar 14 is configured for retaining the plurality of blades 12 in the fully retracted position or state or configuration such as for example during flight. In some embodiments, while the blades 12 are in the retracted configuration, the tips 28 of each of the plurality of blades 12 converge or almost converge to form a distal tip or end 36. In certain embodiments, the distal tip or end 36 is a chisel tip having cutting edges defined at least in part by the first cutting edge 32 of each blade 12. As such, the distal (or chisel) tip 36 is configured for creating a bore in the target. In some embodiments, the plurality of blades 12 are configured such that the distal (or chisel) tip 36 is formed distally or in front of or beyond a distal end 38 of the ferrule 16. In certain embodiments, the plurality of blades 12 are configured such that the distal (or chisel) tip 36 is formed at or proximate the distal end 38 of the ferrule 16. In some embodiments, the distal (or chisel) tip 36 is formed at a location proximal of the distal end 38 of the ferrule 16. In a non-limiting exemplary embodiment, the tips 28 do not align with each other while the blades 12 are in the retracted configuration. Other configurations for forming and/or locating the distal tip 36 as a chisel tip with sharp cutting edges that may become apparent to one skilled in the art are considered as being within the metes and bounds of the instant disclosure.

In a non-limiting exemplary embodiment, the collar 14 functions or operates to at least form the distal chisel tip 36 with cutting edges defined at least in part by the first cutting edge 32 of each of the plurality of blades 12. In some embodiments, the collar 14 is configured to function as such during flight, i.e., before the broadhead 10 impacts a target, and also momentarily after the broadhead 10 impacts the target. As is well known to those skilled in the art, the arrow or bolt, and the broadhead or tip at the distal end thereof, rotates or spins about its longitudinal axis at a relatively high angular velocity when it is discharged from a bow and during flight towards the target. In a non-limiting exemplary embodiment, when the distal chisel tip 36 touches the target, the spinning or rotating cutting edges of the distal chisel tip 36, i.e., the first cutting edges 32 of the blades 12, creates a bore for the broadhead 10 to penetrate the target. As the broadhead 10, with the fully retracted blades 12 spinning, penetrates the target, a force is exerted by the target onto the impact shoulder 30 in the proximal direction which causes the blades 12 to tangentially rotate outward away from the ferrule 16. In some embodiments, the rotation of the blades 12 causes the collar 14 to disintegrate (i.e., shatter or break). As the blades 12 continue to rotate tangentially, the second cutting edge 34 of each blade 12 rotates away from the ferrule 16. The first cutting edges 32 continue to widen and lengthen the bore as the broadhead 10 continues to penetrate the target and the blades 12 and the second cutting edges 34, continue rotating tangentially outwards away from the ferrule 16. In a non-limiting exemplary embodiment, the blades 12 are configured such that when the second cutting edges 34 are sufficiently exposed, the target starts exerting force onto the exposed second cutting edges 34 in the proximal direction until the blades 12 are fully extended or deployed into a swept-back configuration exposing the entirety of the second cutting edges 34. In a non-limiting exemplary embodiment, the second cutting edges 34 of the blades 12 are configured to cut into the target and widen and lengthen the bore as the broadhead 10 continues to bore or penetrate into the target.

In a non-limiting exemplary embodiment, the collar 14 is an O-ring or an elastic band. In some embodiments, the outward rotation of the blades 12 causes the collar 14 to slide in the proximal direction along the contours of the blades 12 until it "slips off" the blades 12. Other forms and/or configurations of collars for retaining the blades 12 in the retracted state during flight, for instance such as those disclosed at least in Applicant's co-owned U.S. Pat. Nos. 8,758,176, 9,228,813, 9,341,449, 9,976,835, 10,012,486, 10,288,392, 10,352,665, 10,352,666, in Applicant's U.S. patent application Ser. No. 29/635,654 which are herein incorporated by reference, and others as are well-known in the art, are considered as being within the metes and bounds of the instant disclosure.

While the broadhead 10 of the instant disclosure is illustrated having three cutting blades 12 in a balanced or even distribution, i.e., 120 degrees apart from one another, around the ferrule 16, this should not be construed a requirement or a limitation. In some non-limiting exemplary embodiments, the broadhead 10 may have two cutting blades 12 disposed 180 degrees apart from each other on the ferrule 16. In certain non-limiting exemplary embodiments, the broadhead 10 may have more than three cutting blades 12 in a balanced even distribution around the ferrule 16. For instance, an exemplary broadhead may have four cutting blades 12 disposed 90 degrees apart from one another around the ferrule 16. As such, broadheads with two or more cutting blades 12 are considered as being within the metes and bounds of the instant disclosure.

In a non-limiting exemplary embodiment, the distal end 38 of the ferrule 16 is configured as a chisel tip or a multi-faceted tip or a trocar tip having a plurality of facets and sharp cutting edges disposed between adjacent facets such as those disclosed at least in Applicant's co-owned U.S. Pat. Nos. 9,410,778, 9,404,722, 8,986,141, 7,771,298, 7,182,706, 7,011,589, 6,942,588, 6,669,586, 6,626,776, 6,554,727, 6,517,454, and in International Publication No. WO 2018/075356, which are herein incorporated by reference in their entirety. As disclosed in one or more of these patents and/or publications, the distal end 38, in some embodiments, is formed as an integral part of the ferrule 16. Also as disclosed in one or more of these patents and/or publications, the distal end 38, in some embodiments, is a discrete component fixedly or removably attached to the ferrule 16. In certain embodiments, the distal end 38 of the ferrule 16 includes one or more cutting edges. Accordingly, in some embodiments, the distal end 38 of the ferrule 16 is configured for creating a bore and/or extending the bore created by the cutting edges of the distal chisel tip 36, i.e., the bore created by the first cutting edges 32 of the blades 12.

In a non-limiting exemplary embodiment, at least a portion of each channel 18 of the plurality of channels is defined at least in part by at least a portion of the ferrule 16 and at least a portion of at least one of the blades 12. In some embodiments, one or more of the channels 18 extend proximally from a location proximal of the distal end 38 of the ferrule 16. In certain embodiments, one or more of the channels 18 extend proximally from proximate the distal end 38 of the ferrule 16. In some embodiments, some of the plurality of channels 18 extend proximally from a location proximal of the distal end 38, and some of the plurality of channels 18 extend proximally from proximate the distal end 38. In certain embodiments, one or more of the channels 18 are configured for relieving fluid pressure as the broadhead 10 bores into a target. In some embodiments, one or more of channels 18 are curvilinear such as for example illustrated by a path 40.

In a non-limiting exemplary embodiment, a proximal end 42 of the ferrule 16 is configured for attaching the broadhead 10 to a shaft of an arrow or a bolt. While the figures of the instant disclosure might imply that the proximal end 42 is threaded, this should not be construed as a limitation or a requirement. In some embodiments, the proximal end 42 may be un-threaded. Other forms and/or configurations for attaching or coupling the broadhead 10 to the shaft of an arrow or bolt, as are well known in the art, are considered as being within the metes and bounds of the instant disclosure.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also encompass any and all equivalents providing functionalities similar to those disclosed herein with reference to the accompanying drawings. Accordingly, the spirit, scope and intent of the instant disclosure is to embrace all such variations. Consequently, the metes and bounds of the instant disclosure are defined by the appended claims and any and all equivalents thereof.

What is claimed is:

1. A broadhead, comprising:

a ferrule;

a plurality of deployable blades rotatably coupled to a surface of the ferrule, each blade comprising:
a tip;
an impact shoulder;
a first cutting edge extending from the tip to proximate the impact shoulder; and
a second cutting edge extending from the tip to proximate a location whereat the blade is coupled to the ferrule; and
a plurality of channels disposed on at least a portion of the surface of the ferrule, wherein at least a portion of each channel is defined at least in part by at least a portion of the ferrule and at least a portion of at least one of the plurality of blades.

2. The broadhead of claim 1, wherein the tips of the plurality of blades converge to form a chisel tip while the plurality of blades are in a retracted configuration, the chisel tip comprising cutting edges defined at least in part by the first cutting edge of each blade.

3. The broadhead of claim 2, wherein the chisel tip is distal of a distal end of the ferrule.

4. The broadhead of claim 2, wherein the chisel tip is proximate a distal end of the ferrule.

5. The broadhead of claim 2, wherein the chisel tip is proximal of a distal end of the ferrule.

6. The broadhead of claim 2, wherein the chisel tip is configured for creating a bore in a target.

7. The broadhead of claim 2, comprising a collar configured for retaining the plurality of blades in the retracted configuration.

8. The broadhead of claim 1, wherein the plurality of blades deploy into a swept-back configuration exposing their respective second cutting edges.

9. The broadhead of claim 8, wherein the second cutting edges are configured for widening a bore in a target.

10. The broadhead of claim 1, wherein the plurality of blades rotate tangentially relative to the surface of the ferrule.

11. The broadhead of claim 1, wherein at least one of the plurality of channels is configured for relieving fluid pressure.

12. The broadhead of claim 1, wherein one or more of the plurality of channels are curvilinear.

13. The broadhead of claim 1, wherein a distal end of the ferrule is configured for creating a bore in a target.

14. The broadhead of claim 1, wherein a distal end of the ferrule comprises cutting edges.

15. A broadhead, comprising:
a ferrule;
a plurality of deployable blades rotatably coupled to a surface of the ferrule; and
a plurality of channels disposed on at least a portion of the surface of the ferrule, wherein at least a portion of each channel is defined at least in part by at least a portion of the ferrule and at least a portion of at least one of the plurality of blades.

16. The broadhead of claim 15, wherein at least one of the plurality of channels is configured for relieving fluid pressure.

17. The broadhead of claim 15, wherein one or more of the plurality of channels is curvilinear.

18. The broadhead of claim 15, wherein a distal end of the ferrule is configured for creating a bore in a target.

19. The broadhead of claim 15, wherein a distal end of the ferrule comprises cutting edges.

20. The broadhead of claim 15, wherein each blade of the plurality of blades comprises:
a tip;
an impact shoulder;
a first cutting edge extending from the tip to proximate the impact shoulder; and
a second cutting edge extending from the tip to proximate a location whereat the blade is coupled to the ferrule.

21. The broadhead of claim 20, wherein the tips of the plurality of blades converge to form a chisel tip while the plurality of blades are in a retracted configuration, the chisel tip comprising cutting edges defined at least in part by the first cutting edge of each blade.

22. The broadhead of claim 21, wherein the chisel tip is distal of a distal end of the ferrule.

23. The broadhead of claim 21, wherein the chisel tip is proximate a distal end of the ferrule.

24. The broadhead of claim 21, wherein the chisel tip is proximal of a distal end of the ferrule.

25. The broadhead of claim 21, wherein the chisel tip is configured for creating a bore in a target.

26. The broadhead of claim 21, comprising a collar configured for retaining the plurality of blades in the retracted configuration.

27. The broadhead of claim 20, wherein the plurality of blades deploy into a swept-back configuration exposing their respective second cutting edges.

28. The broadhead of claim 27, wherein the second cutting edges are configured for widening a bore in a target.

29. The broadhead of claim 20, wherein the plurality of blades rotate tangentially relative to the surface of the ferrule.

30. A broadhead, comprising:
a ferrule; and
a plurality of deployable blades rotatably coupled to a surface of the ferrule, wherein each blade comprises:
a tip;
an impact shoulder;
a first cutting edge extending from the tip to proximate the impact shoulder; and
a second cutting edge extending from the tip to proximate a location whereat the blade is rotatably coupled to the ferrule;
wherein, the plurality of blades rotate tangentially relative to the surface of the ferrule.

31. The broadhead of claim 30, wherein the tips of the plurality of blades converge to form a chisel tip while the plurality of blades are in a retracted configuration, the chisel tip comprising cutting edges defined at least in part by the first cutting edge of each blade.

32. The broadhead of claim 31, comprising a collar configured for retaining the plurality of blades in the retracted configuration.

33. The broadhead of claim 31, wherein the chisel tip is configured for creating a bore in a target.

34. The broadhead of claim 31, wherein the chisel tip is distal of a distal end of the ferrule.

35. The broadhead of claim 31, wherein the chisel tip is proximate a distal end of the ferrule.

36. The broadhead of claim 31, wherein the chisel tip is proximal of a distal end of the ferrule.

37. The broadhead of claim 30, wherein the plurality of blades deploy into a swept-back configuration exposing their respective second cutting edges.

38. The broadhead of claim 37, wherein the second cutting edges are configured for widening a bore in a target.

39. The broadhead of claim 30, comprising a plurality of channels disposed on at least a portion of the surface of the ferrule, wherein at least a portion of each channel is defined at least in part by at least a portion of at least one of the plurality of blades and at least a portion of the ferrule.

40. The broadhead of claim 39, wherein at least one of the plurality of channels is configured for relieving fluid pressure.

41. The broadhead of claim 39, wherein one or more of the plurality of channels are curvilinear.

42. The broadhead of claim 30, wherein a distal end of the ferrule is configured for creating a bore in a target.

43. The broadhead of claim 30, wherein a distal end of the ferrule comprises cutting edges.

44. A broadhead, comprising:

a ferrule; and a plurality of deployable blades rotatably coupled to the ferrule on a surface thereof, wherein, each blade comprises a first and a second cutting edge extending from a tip thereof; and the plurality of blades rotate tangentially relative to the surface of the ferrule.

* * * * *